US008543024B2

(12) United States Patent
Egusa et al.

(10) Patent No.: US 8,543,024 B2
(45) Date of Patent: Sep. 24, 2013

(54) FIXING DEVICE AND IMAGE FORMING APPARATUS USING THE SAME

(75) Inventors: Naoyuki Egusa, Kanagawa (JP); Tetsuro Kodera, Kanagawa (JP); Takashi Matsubara, Kanagawa (JP); Makoto Furuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 150 days.

(21) Appl. No.: 13/225,069

(22) Filed: Sep. 2, 2011

(65) Prior Publication Data

US 2012/0243893 A1 Sep. 27, 2012

(30) Foreign Application Priority Data

Mar. 24, 2011 (JP) ..... 2011-065973

(51) Int. Cl.
*G03G 15/20* (2006.01)

(52) U.S. Cl.
USPC ..... 399/67; 399/336

(58) Field of Classification Search
USPC ..... 399/67, 335, 336
See application file for complete search history.

(56) References Cited

U.S. PATENT DOCUMENTS

| | | | | |
|---|---|---|---|---|
| 6,175,715 | B1 | 1/2001 | Hirao et al. | |
| 8,285,186 | B2 * | 10/2012 | Matsubara et al. | 399/336 |
| 2011/0044740 | A1 * | 2/2011 | Matsubara et al. | 399/335 |
| 2011/0222936 | A1 * | 9/2011 | Matsubara et al. | 399/336 |

FOREIGN PATENT DOCUMENTS

| | | |
|---|---|---|
| JP | A-56-164375 | 12/1981 |
| JP | A-2000-131893 | 5/2000 |
| JP | A-2005-196051 | 7/2005 |
| JP | A-2010-217731 | 9/2010 |

* cited by examiner

*Primary Examiner* — Susan Lee
(74) *Attorney, Agent, or Firm* — Oliff & Berridge, PLC

(57) ABSTRACT

A fixing device includes a first irradiation unit that irradiates a laser beam in a first irradiation region toward a recording medium in which unfixed image is formed; a second irradiation unit that irradiates a laser beam toward a second irradiation region; an image information acquiring unit that acquires image information of the first irradiation region; a coating information acquiring unit that divides the first irradiation region into one or a plurality of divided regions, and that acquires coating information that relates to the coating level on the basis of the image information; a transmission information acquiring unit that acquires transmission information that relates to the laser beam which is irradiated to the first irradiation region and passes through the recording material on the basis of the coating information; an irradiation control unit that controls the irradiation energy of the second irradiation unit based on the transmission information.

20 Claims, 23 Drawing Sheets

(FIG. 10 Continued)
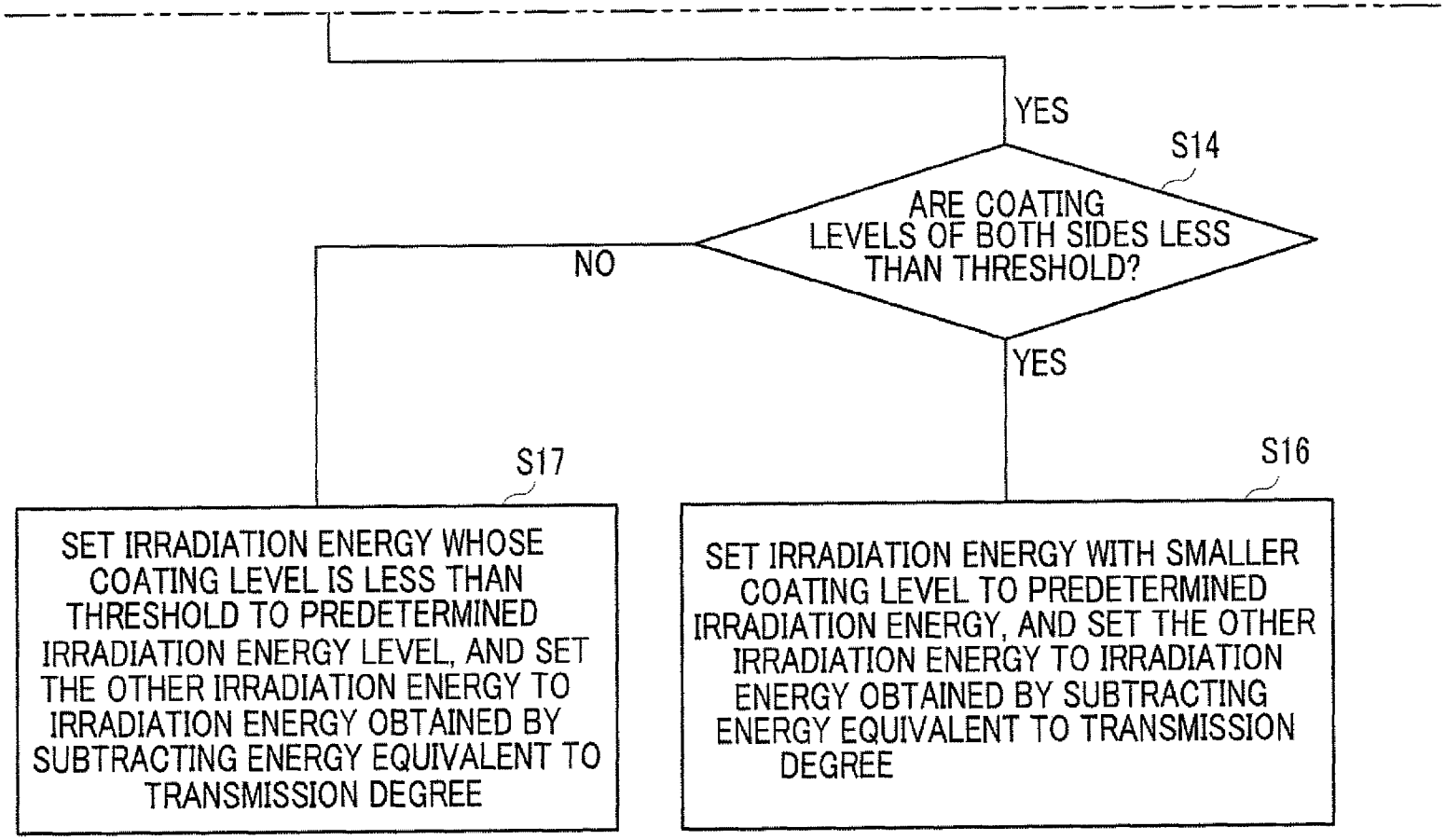

FIG. 11B

| DIVISION OF THRESHOLD | a | b | c |
|---|---|---|---|
| IRRADIATION ENERGY | A | B | C |

HERE, a>b>c and INITIAL SETTING VALUE>A>B>C

FIG. 18

| COATING LEVEL OF SIDE A | TRANSMISSION POWER TO SIDE B WHEN LASER POWER OF SIDE A IS SET TO 100% | LASER POWER REQUIRED FOR SIDE B |
|---|---|---|
| 100 % | 0 % | 100 % |
| 60 % | 12 % | 88 % |
| 50 % | 15 % | 85 % |
| 40 % | 18 % | 82 % |
| 30 % | 21 % | 79 % |
| 20 % | 24 % | 74 % |
| 10 % | 27 % | 73 % |
| 5 % | 28.5 % | 71.5 % |

FIXING DEVICE AND IMAGE FORMING APPARATUS USING THE SAME

CROSS-REFERENCE TO RELATED APPLICATIONS

This application is based on and claims priority under 35 USC 119 from Japanese Patent Application No. 2011-065973 filed Mar. 24, 2011.

BACKGROUND

Technical Field

The present invention relates to a fixing device and an image forming apparatus using the same.

SUMMARY

According to an aspect of the invention, there is provided a fixing device including a first irradiation unit that irradiates a laser beam in a first irradiation region toward a recording medium in which unfixed image is formed on both sides thereof using an image forming material capable of being heated and fixed; a second irradiation unit that irradiates a laser beam toward a second irradiation region disposed in rear side of the first irradiation region of the recording medium; an image information acquiring unit that acquires image information of the first irradiation region; a coating information acquiring unit that divides the first irradiation region into one or a plurality of divided regions, and that acquires coating information that relates to the coating level by the image forming material within the divided region on the basis of the image information acquired by the image information acquiring unit; a transmission information acquiring unit that acquires transmission information that relates to the laser beam which is irradiated from the first irradiation unit to the first irradiation region and passes through the recording material on the basis of the coating information acquired by the coating information acquiring unit; an irradiation control unit that controls the irradiation energy of the second irradiation unit based on the transmission information acquired by the transmission information acquiring unit.

BRIEF DESCRIPTION OF THE DRAWINGS

Exemplary embodiments of the present invention will be described in detail based on the following figures, wherein:

FIG. 11B shows an example of a table;

FIG. 18 is a table showing results of an example.

DETAILED DESCRIPTION

Outline of Exemplary Embodiment

Figure 1A:
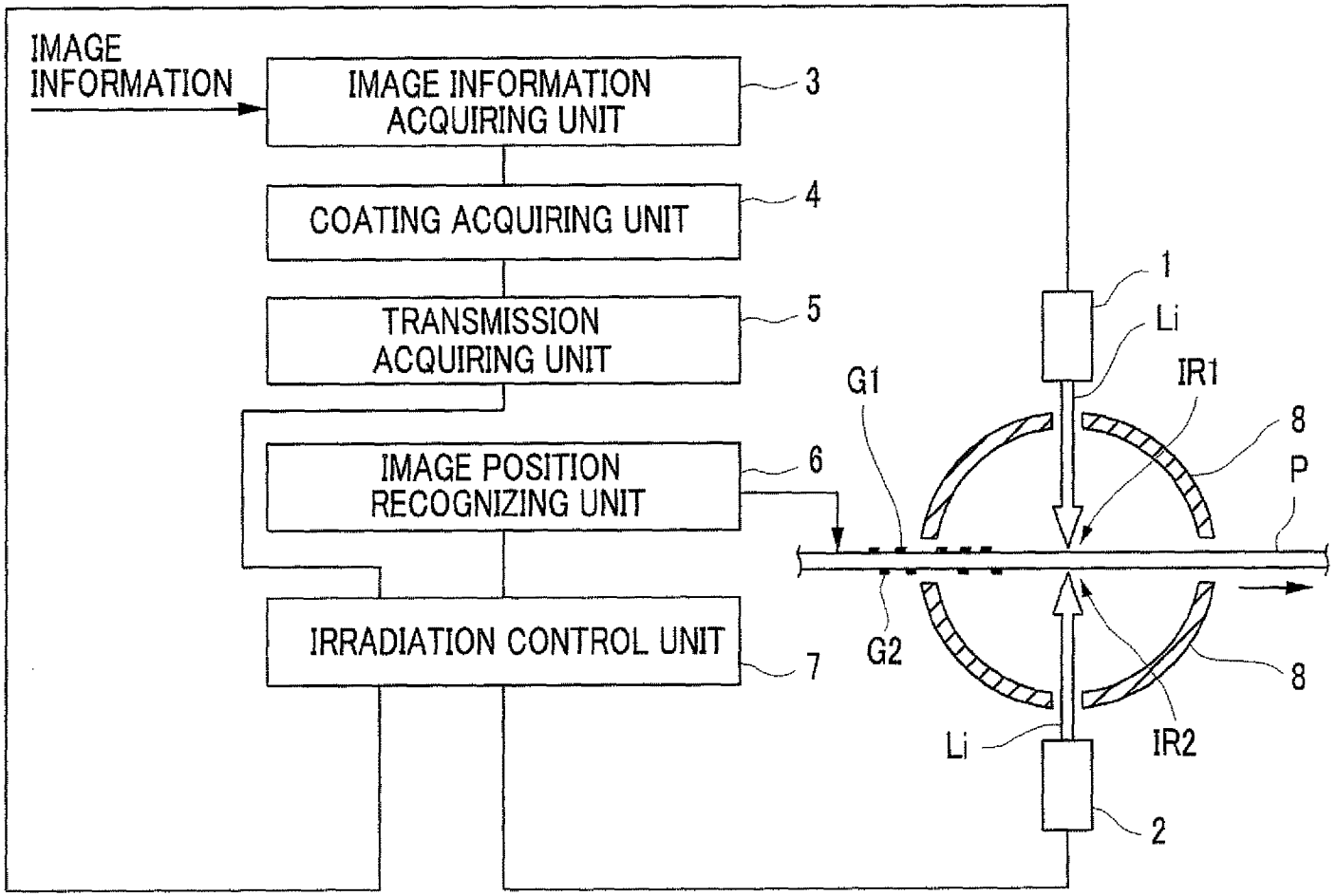
FIG. 1A is an explanatory view showing the outline of a fixing device related to an exemplary embodiment model that embodies the invention.
Figure 1B:
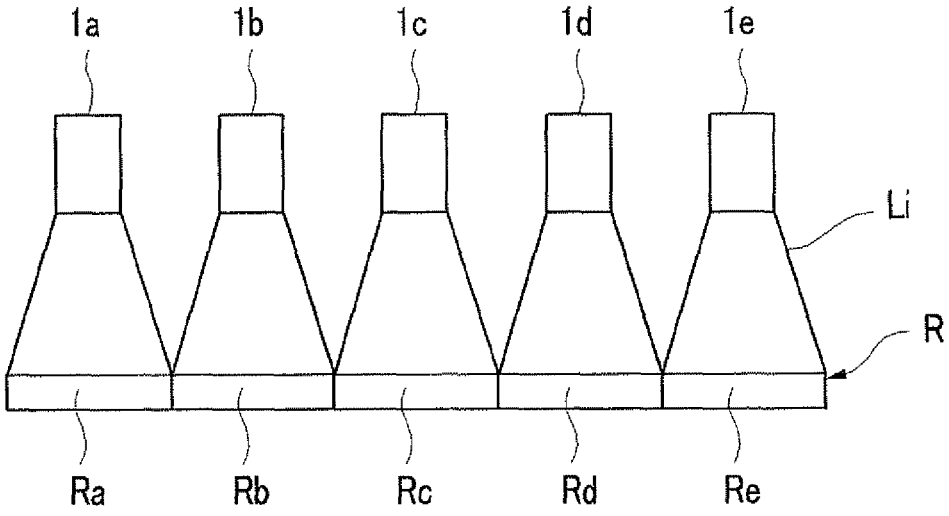
FIG. 1B is an explanatory view showing the relationship between divided regions and laser beam sources.

First, the outline of an exemplary embodiment model of a fixing device to which the invention is applied will be described using an explanatory view of a fixing device related to an exemplary embodiment model that embodies the invention of FIGS. 1A and 1B. In addition, FIG. 1A shows the outline of an overall configuration, and FIG. 1B shows the relationship between divided regions and laser beam sources.

In this drawing, the fixing device includes a first irradiation unit 1 that is provided to face one side of a recording material P on both sides of which unfixed images G (G1, G2) using an image forming material capable of being heated and fixed are formed and that irradiates a laser beam Li toward a belt-like first irradiation region IR1 that extends along a direction that crosses a movement direction of the recording material P, a second irradiation unit 2 that is provided to face the other side of the recording material P and that irradiates a laser beam Li toward a belt-like second irradiation region IR2 provided to correspond to the first irradiation region IR1, an image information acquiring unit 3 that acquires image information on an unfixed image G formed at least on one side of the recording material 2, a coating information acquiring unit 4 that divides the irradiation region IR of the laser beam Li using the first or second irradiation unit 1 or 2 corresponding to a side from which the image information is acquired into one or plural divided regions R (for example, Ra to Re), on the basis of the image information acquired by the image information acquiring unit 3 and that acquires coating information that relates to the coating level by the image forming material within the divided region R, a transmission information acquiring unit 5 that acquires transmission information that relates to the transmission degree of the laser beam Li through the recording material P on the basis of the coating information acquired by the coating information acquiring unit 4, an image position recognizing unit 6 that recognizes the image position of the unfixed images G formed on both sides of the recording material P in relation to the irradiation regions IR, and an irradiation control unit 7 that sets the irradiation energy of the irradiation unit 1 or 2 corresponding to a side from which image information is acquired by the image information acquiring unit 3 to a predetermined irradiation energy level, in setting the irradiation energy of the first and second irradiation units 1 and 2 for the divided regions R in a case where the unfixed images G recognized by the image position recognizing unit 6 reach the irradiation regions IR and that controls the first and second irradiation units 1 and 2 such that the irradiation energy of the other irradiation unit 2 or 1 is set to a value obtained by subtracting the irradiation energy based on the transmission information acquired by the transmission information acquiring unit 5 from the predetermined irradiation energy level.

Here, although an aspect of continuous paper (rolled paper and continuous-form paper) is representatively mentioned as the recording material P, even a paper sheet (cut sheet) may be adopted for a system in which unfixed images G are formed on both sides and are fixed simultaneously from both sides of the paper sheet. For such a paper sheet, for example, perforations or the like may be utilized, for example if an unfixed image G is not formed at both end parts of the recording material P in the width direction thereof.

Additionally, both the first and second irradiation units 1 and 2 may be those capable of irradiating laser beams Li, and representatively include units of an array laser type in which plural laser beam sources 1*a* to 1*e* are arranged in one row along the width direction of the recording material P. Moreover, the first and second irradiation regions IR1 and IR2 provided to correspond to both sides of the recording material P, respectively, may be respectively provided at plural locations along the movement direction of the recording material P. In that case, irradiation units 1 and 2 corresponding to the plural irradiation regions may be provided. Additionally, the predetermined irradiation energy level of the irradiation units 1 and 2 may be irradiation energy for being sufficiently fixed, for example, even if unfixed images G in which the coating level of an image forming material is large are formed on both sides of the recording material P. Usually, the irradiation energy that is initially set is sufficient.

The image information acquiring unit 3 acquires image information on an unfixed image G formed at least on one side of the recording material P. The timing when the image information is acquired is not particularly limited. For example, image information that is equivalent to one sheet of an image may be acquired at a time.

Additionally, the coating information acquiring unit 4 acquires coating information on the image forming material within the divided region R of the irradiation region IR1 of the laser beam Li using an irradiation unit (for example, the first irradiation unit 1) corresponding to a side where the image information is acquired, on the basis of the image information acquired by the image information acquiring unit 3. The coating information includes the coating level of the image forming material, and includes adding factors (color tone, image type, and the like) that influence the coating level. Additionally, as the "divided region R", the overall irradiation region IR may be one divided region R, or the irradiation region IR may be respective divided regions R (for example, Ra to Re) that are divided into plural regions. However, regions corresponding to laser beam sources (for example, 1*a* to 1*e*) of the irradiation units 1 and 2 become minimum divided regions R.

Moreover, although the transmission information acquiring unit 5 may be adapted to acquire transmission information on the transmission degree of the laser beam Li on the basis of the coating information obtained by the coating information acquiring unit 4, for example, it is preferable to acquire respective transmission information items according to the thickness and kind of the recording material P. Additionally, the image position recognizing unit 6 recognizes the image position of the unfixed image G of the recording material P in relation to the irradiation region IR, and may confirm, for example, the position of the unfixed image G at a position before fixation by a sensor or the like and recognize the timing when the unfixed image G reaches the irradiation region IR, for example, from the movement speed or the like of the recording material P.

The irradiation control unit 7 sets the irradiation energy of the first and second irradiation units 1 and 2 for the divided regions R in a case where the unfixed images G recognized by the image position recognizing unit 6 reach the irradiation regions IR, sets the irradiation energy of the irradiation unit (for example, 1) corresponding to a side from which image information is acquired by the image information acquiring unit 3 to a predetermined irradiation energy level, and sets the irradiation energy of the other irradiation unit (for example, 2) to a value obtained by subtracting the irradiation energy based on the transmission information acquired by the transmission information acquiring unit 5 from the predetermined irradiation energy level.

Here, the reason why the irradiation energy is reduced will be described with reference to FIG. 2.

Figure 2:
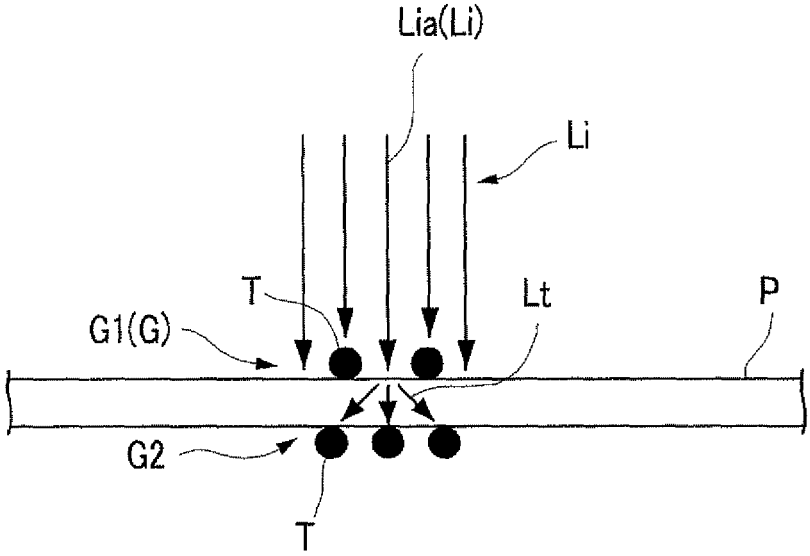
FIG. 2 is an explanatory view showing the action of a laser beam onto an unfixed image.

As shown in FIG. 2, an unfixed image G on the top face side (in the drawing) of a recording material P is defined as G1, and an unfixed image G on the bottom face side is defined as G2. Now, if the coating level is assumed to be coating information from an image forming material (here, shown as a toner T) that forms the unfixed image G1, a gap is present between the recording material and the toner T to the extent that the coating level is smaller, when the coating level is smaller than 100%. At this time, the laser beam Li irradiated onto the unfixed image G1 side is irradiated by a part with no toner T. For example, when attention is paid to a laser beam Lia, this laser beam Lia is directly irradiated to the top face of the recording material P, a part of the laser beam is reflected by the surface of the recording material P, and a part of the laser beam becomes transmitted light Lt that is transmitted through the recording material P. Such transmitted light Lt is scattered inside the recording material P, and reaches a widespread part on the bottom face side of the recording material P.

Therefore, when the unfixed image G1 on the top face side is irradiated with the laser beam Li, the toner T on the top face side is fixed, and the irradiation energy of the laser beam Li from the top face side is also imparted to the toner T at the widespread part of the unfixed image G2 side on the bottom face side due to the transmitted light Lt scattered through the recording material P even if the toner T of the unfixed image G2 on the bottom face side is directly under the laser beam Lia. As the irradiation energy of the laser beam Li on the top face side is imparted to the unfixed image G2 on the bottom face side in this way, the temperature of the toner T of the unfixed image G2 on the bottom face side also rises. Accordingly, in such a case, even if the irradiation energy from the bottom face side is made small, the unfixed image G2 on the bottom face side is sufficiently fixed. Therefore the irradiation energy of the laser beam Li on the bottom face side may be made small compared to that on the top face side by the irradiation energy based on the transmission degree of the transmitted light Lt.

Although it is possible to make the irradiation energy of the second irradiation unit 2 on the bottom face side small by such an action, the fixation state of the unfixed image G may be confirmed and determined in advance by an experiment or the like as the transmission degree of the transmitted light Lt. Additionally, since a case where such a transmission degree changes depending on the kind, thickness, and the like of the recording material P is assumed, it is more preferable to obtain the transmission degree of the laser beam Li depending on the kind, thickness, and the like by an experiment or the like. In addition, the image forming material is not limited to the toner T, and may be a material fixed under heating by the laser beam Li. For example, the image forming material also widely includes a thermoplastic material that forms an image on the recording material P using an ink jet method.

Moreover, such coating information may be obtained, for example, by adding the transmission of the laser beam Li of the image forming material itself to the coating level in addition to the coating level of the image forming material. For example, in a photographic image, the coating information may not be acquired, and coating information only on a character image may be acquired.

From the viewpoint that the first and second irradiation units 1 and 2 are more finely controlled, preferably, the first and second irradiation units 1 and 2 have plural laser beam sources 1*a* to 1*e* arranged along the respective irradiation regions IR, and, the divided region R is a region that is divided so as to correspond to an irradiation range obtained by one or plural laser beam sources 1*a* to 1*e* among the plural laser beam sources 1*a* to 1*e*. The number of the laser beam sources 1*a* to 1*e* is not particularly limited, and may be arranged so as to be able to cover a region capable of fixing the unfixed image G on the recording material P. Therefore, the divided region R may be the irradiation range of a laser beam Li by one laser beam source (for example, 1*a*), or may be the irradiation ranges of laser beams Li by plural adjacent laser beam sources (for example, 1*a* and 1*b*).

Moreover, from the viewpoint that improvement in fixation efficiency is effectively achieved, preferably, the transmission information acquiring unit 5 determines, as a threshold, minimum transmission information close to zero including a transmission degree of at least zero on the basis of the coating information acquired by the coating information acquiring unit 4, regards the transmission information as transmission information of a transmission degree of zero when the coating information is equal to or more than the threshold, and acquires the transmission information when the coating information is less than the threshold. That is, not by controlling the irradiation energy merely according to coating information, but by providing a predetermined threshold for coating information, regarding the transmission degree as zero when the coating information is equal to or more than this threshold, regards the transmission degree as a value other than zero when the coating information is less than the threshold, and subtracting the irradiation energy based on transmission information related to this, securing of the transmission degree becomes a prerequisite and the control in the irradiation control unit 7 also becomes easy. Such a threshold may be determined by an experiment or the like, for example, may be a threshold of the coating level or may be a threshold obtained by adding the color tone of the image forming material, an assortment according to a monochrome image, a color image, or the like. For example, when the threshold of the coating level is provided, a numerical value such as 60% is used, and when the threshold of the coating level is less than 60%, the irradiation energy based on the coating level may be subtracted. Additionally, when plural thresholds are provided, the irradiation energy subtracted for each threshold may be uniformly determined.

From the viewpoint of ease of discrimination, as the coating information, preferably the coating information acquiring unit 4 uses the coating level of the image forming material as the coating information.

In the above aspect, attention is paid to the coating information in the unfixed image G of either side of the recording material P, the irradiation energy for a side where coating information is acquired is set to a predetermined irradiation energy level, and the irradiation energy for the other side is controlled on the basis of the coating information. However, coating information is obtained for only one predetermined side of the recording material P is acquired, and the irradiation energy corresponding to the other side may be set to a value obtained by subtracting the irradiation energy based on the transmission information.

Moreover, when attention is paid to coating information on unfixed images G on both sides of the recording material P as the coating information, it is more preferable to perform the following. That is, as shown in FIGS. 1A and 1B, the image information acquiring unit 3 may acquire image information on the unfixed images G formed on both sides of the recording material P, the coating information acquiring unit 4 may acquire the size relation of coating information from the image forming material in the divided regions R corresponding to both sides of the recording material P from the coating information on the image forming material within the divided regions R in the irradiation regions IR of the laser beams Li using the first and second irradiation units 1 and 2, on the basis of the image information on the unfixed images G formed on both sides of the recording material P acquired by the image information acquiring unit 3, and the irradiation control unit 7 may set the irradiation energy of the irradiation unit 1 or 2 corresponding to a side with less coating information to a predetermined irradiation energy level, when the coating information of either side is acquired to be less than the other by the coating information acquiring unit 4, in setting the irradiation energy of the first and second irradiation units 1 and 2 for the divided regions R in a case where the unfixed images G recognized by the image position recognizing unit 6 reach the irradiation regions IR and may control the first and second irradiation units 1 and 2 such that the irradiation energy of the other irradiation unit 2 or 1 is set to a value obtained by subtracting the irradiation energy based on the transmission information acquired by the transmission information acquiring unit 5 from the predetermined irradiation energy level.

That is, when there is less coating information on one unfixed image G in the unfixed images G on both sides of the recording material P than coating information on the other unfixed image G, irradiation energy to a side with less coating information is set to the predetermined irradiation energy level, and irradiation energy to a side with larger coating information is made small. In this case, by giving the predetermined irradiation energy level to the unfixed image G with less coating information, the transmission degree of the laser beam Li that is transmitted through the recording material P becomes larger than a case where the same irradiation energy is imparted to the side with larger coating information. As a result, the irradiation energy as a whole may be made small to that extent.

Additionally, when there is no difference in coating information in the unfixed mages G on both sides of the recording material P, irradiation control from either side may be performed.

Moreover, from the viewpoint of improving the fixation efficiency, preferably the fixing device may further include a pair of reflective members 8 that is provided so as to surround the first and second irradiation regions IR1 and IR2, respectively, and are adapted to reflect the reflected light from each of the first and second irradiation regions IR1 and IR2 obtained by the laser beam Li irradiated from the first and second irradiation units 1 and 2 so as to be directed again to the recording material P. Here, the reflected light also includes the scattered light from the irradiation regions IR1 and IR2. In such reflective members 8, a reflecting surface side may be, for example, a curved mirror surface, or the reflecting surface side may be a recursive reflecting surface or scattering surface. Moreover, such reflective members 8 may have an integral configuration or a split configuration.

Additionally, from the viewpoint of further improving the fixation efficiency, the first and second irradiation regions IR1 and IR2 used by the first and second irradiation units 1 and 2 may be set so as to incline in the width direction of the recording material P that crosses the movement direction of the recording material P. Under normal circumstances, an image on the recording material P is formed in a direction along the width direction of the recording material P or a direction orthogonal to the width direction. Therefore, if the first and second irradiation regions IR1 and IR2 are made to incline from the width direction of the recording material P in this way, the apparent coating level of the first and second irradiation regions IR1 and IR2 becomes small, the transmitted light produced by the laser beam Li is further effectively used correspondingly, and the fixation efficiency is enhanced.

Moreover, from the viewpoint of making effective the heating action of the image forming material using the transmitted light of the recording material P produced by the laser beam Li, the following configuration may be adopted. That is, the fixing device includes a first irradiation unit 1 that is provided to face one side of a recording material P on both sides of which unfixed images G using an image forming material capable of being heated and fixed are formed and that irradiates a laser beam Li toward a belt-like first irradiation region IR1 that extends along a direction that crosses a movement direction of the recording material P, a second irradiation unit 2 that is provided to face the other side of the recording material P and that irradiates a laser beam Li toward a belt-like second irradiation region IR2 provided to correspond to the first irradiation region IR1, an image information acquiring unit 3 that acquires image information on the unfixed images G formed on both sides of the recording material 2, a coating information acquiring unit 4 that divides the irradiation region IR of the laser beam Li using the first and second irradiation units 1 and 2 into one or plural divided regions R, on the basis of the image information acquired by the image information acquiring unit 3 and that acquires coating information that relates to the coating level by the image forming material within the divided region R, a transmission information acquiring unit 5 that acquires transmission information that relates to the transmission degree of the laser beam Li through the recording material P on the basis of the coating information acquired by the coating information acquiring unit 4, an image position recognizing unit 6 that recognizes the image position of the unfixed images G formed on both sides of the recording material P in relation to the irradiation regions IR, and an irradiation control unit 7 that takes into consideration transmission information on both sides of the recording material P, in setting the irradiation energy of the first and second irradiation units 1 and 2 for the divided regions R in a case where the unfixed images G recognized by the image position recognizing unit 6 reach the irradiation regions IR and that controls the first and second irradiation units 1 and 2 such that the sum of the irradiation energy of one irradiation unit 1 or 2 and irradiation energy based on the transmission information of the other irradiation unit 2 or 1 becomes a predetermined irradiation energy level.

In this case, by mutually associating coating information between both sides of the recording material P, reduction of irradiation energy is achieved compared to a case where irradiation energy on one side is set to a predetermined irradiation energy level. For example, a case where the coating level of the image forming material is assumed as the coating information, a case where the coating levels of both sides are 100% and 50%, and a case where both the coating levels are 50% are mentioned as examples, the results are given hereafter.

When a value obtained by subtracting the irradiation energy based on transmission information is used for only irradiation energy on one side, the irradiation energy of both sides is set to the same irradiation energy in the case where the coating levels of both sides are 100% and 50%, and the case where both the coating levels are 50%. On the other hand, when both sides are mutually associated, only irradiation energy on one side becomes the same that of a case where transmission information is referred to in the case where the coating levels of both sides are 100% and 50%, and the irradiation energy that refers to mutual transmission information is added to both sides in the case where both the coating levels are 50%. Therefore, the total irradiation energy is reduced correspondingly.

From the viewpoint of making effective use of heat transfer to the other side by the laser beam Li from one side, the following configuration may be adopted. That is, the fixing device includes a first irradiation unit 1 that is provided to face one side of a recording material P on both sides of which unfixed images G using an image forming material capable of being heated and fixed is formed and that irradiates a laser beam Li toward a belt-like first irradiation region IR1 that extends along a direction that crosses a movement direction of the recording material P, a second irradiation unit 2 that is provided to face the other side of the recording material P and that irradiates a laser beam Li toward a belt-like second irradiation region IR2 provided to correspond to the first irradiation region IR1 at a position that is displaced nearer to the downstream side in the movement direction of the recording material P than the first irradiation region IR1 in a range where remaining heat caused by the irradiation energy in the first irradiation region IR1 is held, an image information acquiring unit 3 that acquires image information on an unfixed image G formed at least on one side on the first irradiation region IR1 side of the recording material P, a coating information acquiring unit 4 that divides the first irradiation region IR1 corresponding to a side from which the image information is acquired into one or plural divided regions, on the basis of the image information acquired by the image information acquiring unit 3 and that acquires coating information that relates to the coating level by the image forming material within the divided region R, a transmission information acquiring unit 5 that acquires transmission information that relates to the transmission degree of the laser beam Li through the recording material P on the basis of the coating information acquired by the coating information acquiring unit 4, an image position recognizing unit 6 that recognizes the image position of the unfixed images G formed on both sides of the recording material P in relation to the first and second irradiation regions IR1 and IR2, and an irradiation control unit 7 that sets the irradiation energy of the first irradiation unit 1 to a predetermined irradiation energy level, in setting the irradiation energy of the first and second irradiation units 1 and 2 for the divided regions R in a case where the unfixed images G recognized by the image position recognizing unit 6 reach the first and second irradiation regions IR1 and IR2, respectively and that controls the first and second irradiation units 1 and 2 such that the irradiation energy of the second irradiation unit 2 is set to a value obtained by subtracting the irradiation energy based on the transmission information acquired by the transmission information acquiring unit 5 from the predetermined irradiation energy level.

In this case, due to the irradiation energy in the first irradiation region IR1, there is a temperature rise of the image forming material on the second irradiation region IR2 side, and the temperature of the recording material P itself also rises. Therefore, the irradiation energy in the second irradiation region IR2 is reduced in a range where this remaining heat is held. From the viewpoint of effective use of the transmitted light of the laser beam Li caused by the first irradiation unit 1, it is more preferable that the second irradiation region IR2 be displaced in a state where the first irradiation region IR1 and second irradiation region IR2 overlap each other partially.

In order to apply such a fixing device to an image forming apparatus, in an aspect including a transporting unit that conveys a recording material P, an image forming section that forms unfixed images G with an image forming material capable of being heated and fixed on both sides of the recording material P, and a fixing device that fixes the unfixed images G formed on both sides of the recording material P by the image forming section, the above-described fixing device may be used as a fixing device.

Next, the invention will be described in more detail on the basis of exemplary embodiments shown in a drawing.

Exemplary Embodiment 1

Figure 3:
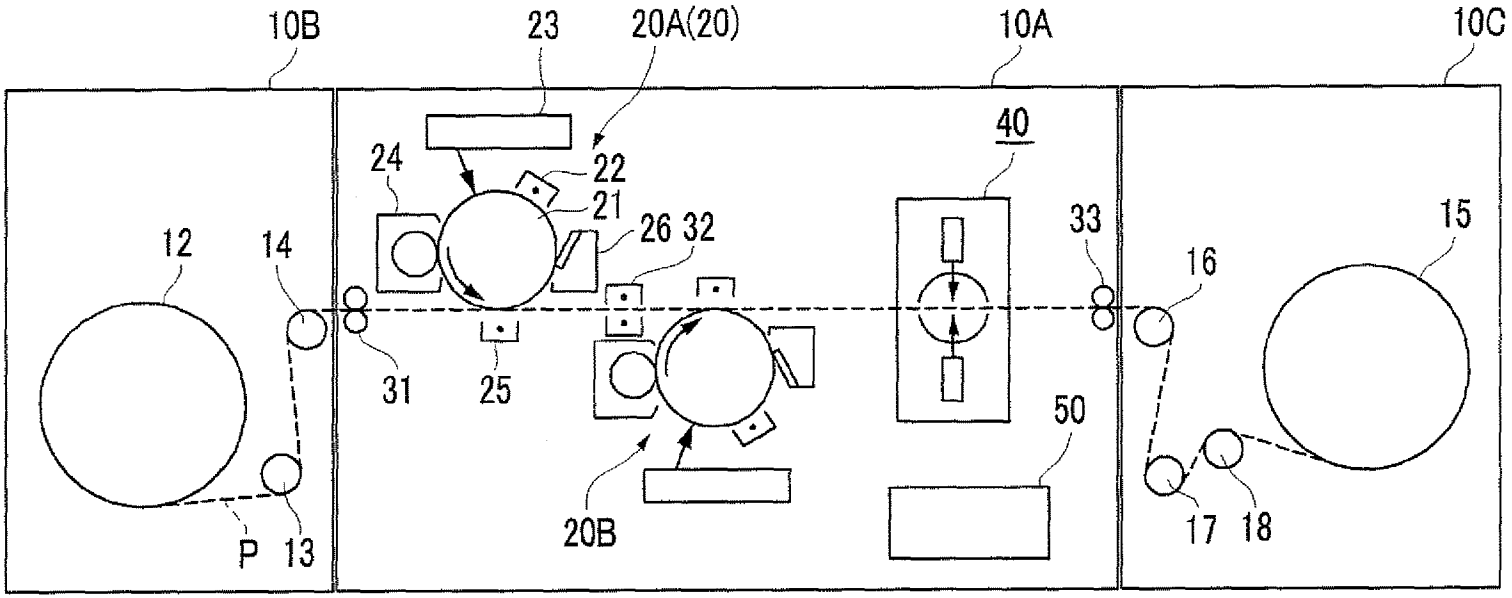
FIG. 3 is an explanatory view showing the outline of an image forming apparatus according to Exemplary Embodiment 1.

FIG. 3 is an explanatory view showing the outline of an image forming apparatus related to Exemplary Embodiment 1 to which the fixing device of the aforementioned embodiment model is applied as an example.

The image forming apparatus of the present exemplary embodiment is configured using a roll-like recording material P, and is provided with an image forming apparatus body 10A that forms toner images serving as images on both sides of the recording material P, a supply device 10B that supplies the recording material P to the upstream side and the downstream side of the image forming apparatus body 10A in the transport direction of the recording material P, and an accommodating device 10C that accommodates the recording material. P on which the images are formed. In addition, the recording material P is not limited to the roll-like recording material, and may have a folded shape in the shape of continuous-form paper.

The image forming apparatus body 10A of the present exemplary embodiment adopts, for example, an electrophotographic system, and has a first image forming section 20A (20) that forms a monochrome image on one side of the recording material P, a second image forming section 20B that forms a monochrome image on a side different from the side of the recording material P formed in the first image forming section 20A. Additionally, a carrying-in roll 31 for carrying in the recording material P supplied from the supply device 10B to the image forming apparatus body 10A side, a polarity reversing device 32 for reversing the polarity of a toner image transferred onto the recording material P in the first image forming section 20A, and an ejection roller 33 that ejects the recording material P to the accommodating device 10C from the image forming apparatus body 10A are provided in a transport path of the recording material P. Moreover, in the present exemplary embodiment, a fixing device 40 for fixing an unfixed toner image on the recording material P is provided between the second image forming section 20B and the ejection roller 33.

Additionally, the supply device 10B is composed of a supply roller 12 that holds the recording material P wound around a core in the shape of a roll, tensioning rollers 13 and 14 that give tension while being transported in order to supply the recording material P to the image forming apparatus body 10A side, and the like. On the other hand, the accommodating device 10C is composed of a winding roller 15 that winds and accommodates the recording material P around the core, various tensioning rollers 16 to 18 that wind the recording material P ejected from the image forming apparatus body 10A and wind the recording material around the winding roller 15, and the like.

Since the first image forming section 20A and the second image forming section 20B of the image forming apparatus body 10A form unfixed toner images on mutually different sides of the recording material P, respectively, and have almost the same configuration, the first image forming section 20A (20) will be representatively described here.

The first image forming section 20A has a cylindrical photoreceptor 21 that has a photosensitive layer (not shown) on the surface thereof and rotates in the direction of an arrow, and a charging device 22 that charges the photosensitive layer of the photoreceptor 21 with predetermined potential, an exposure device 23 that selectively irradiates the photosensitive layer charged by the charging device 22, for example, using a laser beam to form an electrostatic latent image on the photoreceptor 21, a developing device 24 that visualizes the electrostatic latent image formed by the exposure device 23 with a toner, a transfer device 25 that transfers the toner image on the photoreceptor 21 onto a recording material P, a cleaning device 26 that cleans the residual toner on the photoreceptor 21 after transfer, and the like are arranged around the photoreceptor 21.

Additionally, the polarity reversing device 32 is adapted to exert such an electric field that the polarity of the toner transferred from both sides of the recording material P is reversed, onto the toner image transferred in the first image forming section 20A in order to reverse the polarity of the toner image. For example, when negatively charged toner is used in the first image forming section 20A, for example, an electric field that makes the toner side a grounded side and makes the recording material P side a positive side is exerted.

Therefore, when a toner image is transferred from the second image forming section 20B, a state where the toner image transferred by the first image forming section 20A is stabilized with respect to the recording material P is maintained, and stable unfixed toner images are formed on both sides of the recording material P after passing through the second image forming section 20B. In addition, in the drawing, reference numeral 50 designates a control device, and is adapted not only to perform image control within the image forming apparatus body 10A, but also perform the control of the fixing device 40.

In such an image forming apparatus, toner images are sequentially transferred to the recording material P supplied from the supply device 10B by the first and second image forming sections 20A and 20B of the image forming apparatus body 10A, and unfixed toner images are formed on both sides of the recording material P. The unfixed toner images on the recording material P are fixed by the fixing device 40, and are then wound and received by the accommodating device 10C.

Next, the fixing device 40 in such an image forming apparatus will be described.

Figure 4:
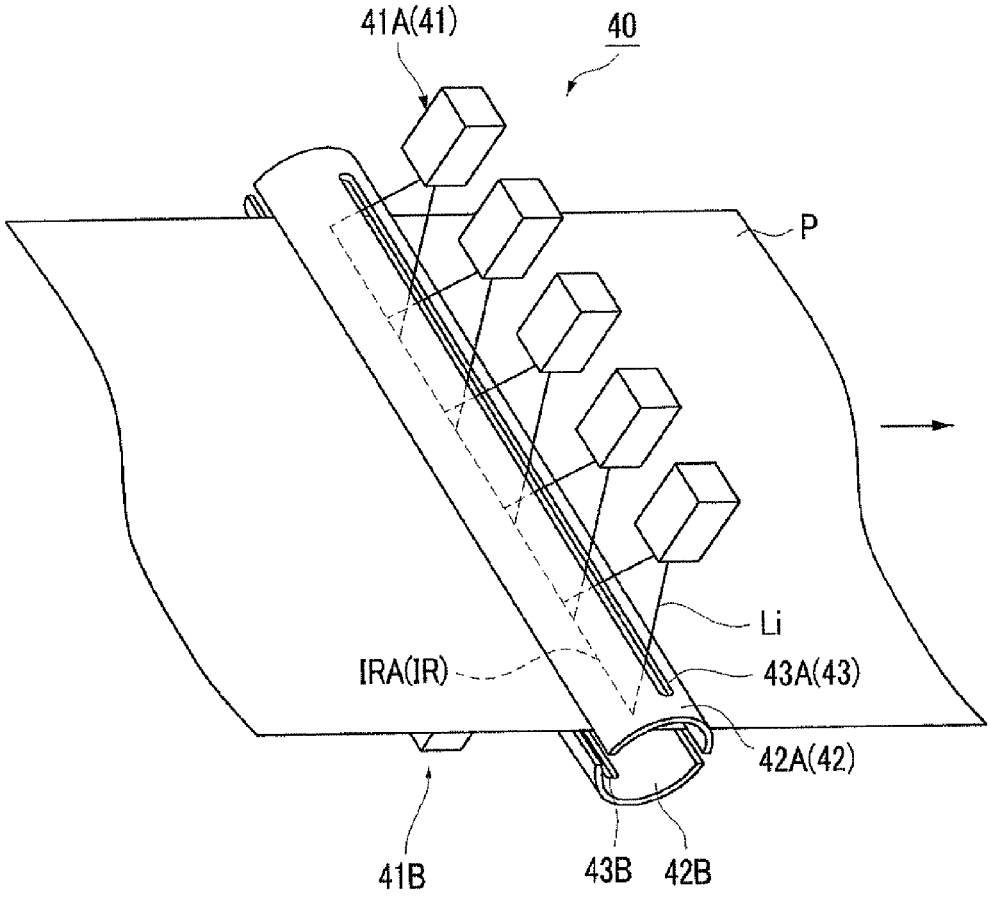
FIG. 4 is a perspective view showing the fixing device of Exemplary Embodiment 1.
Figure 5:
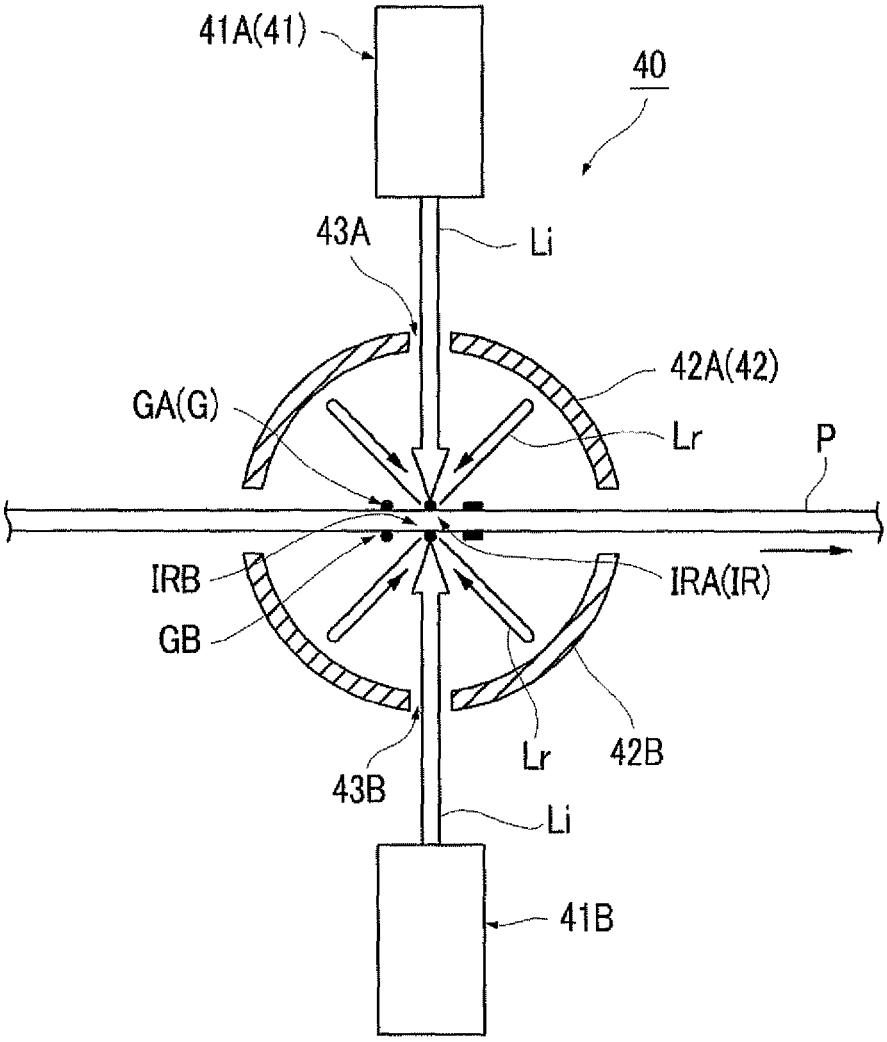
FIG. 5 is an explanatory view showing the outline of the fixing device of Exemplary Embodiment 1.

FIG. 4 is a perspective view when the fixing device 40 is seen from an angle, and FIG. 5 is an explanatory view showing an outline as seen in a direction along the width direction that crosses the transport direction of the recording material P.

The fixing device 40 of the present exemplary embodiment includes a first array laser 41A that is provided to face one side of the recording material P on both sides of which unfixed toner images G (specifically, GA and GB) capable of being heated and fixed are formed and that irradiate a laser beam Li toward a belt-like first irradiation region IRA that extends along a direction that crosses the transport direction of the recording material P, a second array laser 41B that is provided to face the other side of the recording material P and that irradiate a laser beam Li toward a belt-like second irradiation region IRB that is provided to correspond to the first irradiation region IRA, and a pair of reflective members 42 (42A, 42B) that is provided so as to surround the first and second irradiation regions IRA and IRB and that reflect the reflected light from the first and second irradiation regions IRA and IRB caused by the laser beams Li irradiated from the first and second array lasers 41A and 41B so as to be directed again to the recording material P. Here, an aspect in which the irradiation region IR is one divided region is shown.

Although the present exemplary embodiment shows that five high-output semiconductor lasers (equivalent to the laser beam sources) are used as the array lasers 41 (41A, 41B), the number of lasers is not limited, and several lasers may be used. The laser beam Li may be irradiated with a length such that an image region in the width direction of the recording material P may be covered. Additionally, the array lasers 41 include, for example, an optical system in which the laser beam Li is converged on the irradiation region IR (IRA, IRB) on the recording material P. In the irradiation region IR, the irradiation intensity of the laser beam Li along the longitudinal direction in the irradiation region IR is set to become substantially equal as laser beams Li from adjacent high-output semiconductor lasers overlap each other partially at mutual ends thereof.

Additionally, a substantially central portion of a semi-cylindrical shape of the reflective member 42 (42A, 42B) is provided with an opening 43A, 43B as a long hole through which the laser beam Li from the array laser 41 (41A, 41B) is able to be irradiated toward each irradiation region IR (IRA, IRB). Such reflective members 42 may be integral, or may be split, for example, with the opening 43A, 43B as a border. Additionally, the reflective member may have a layout in which the array laser 41 contacts the opening 43A, 43B directly.

Figure 6A:
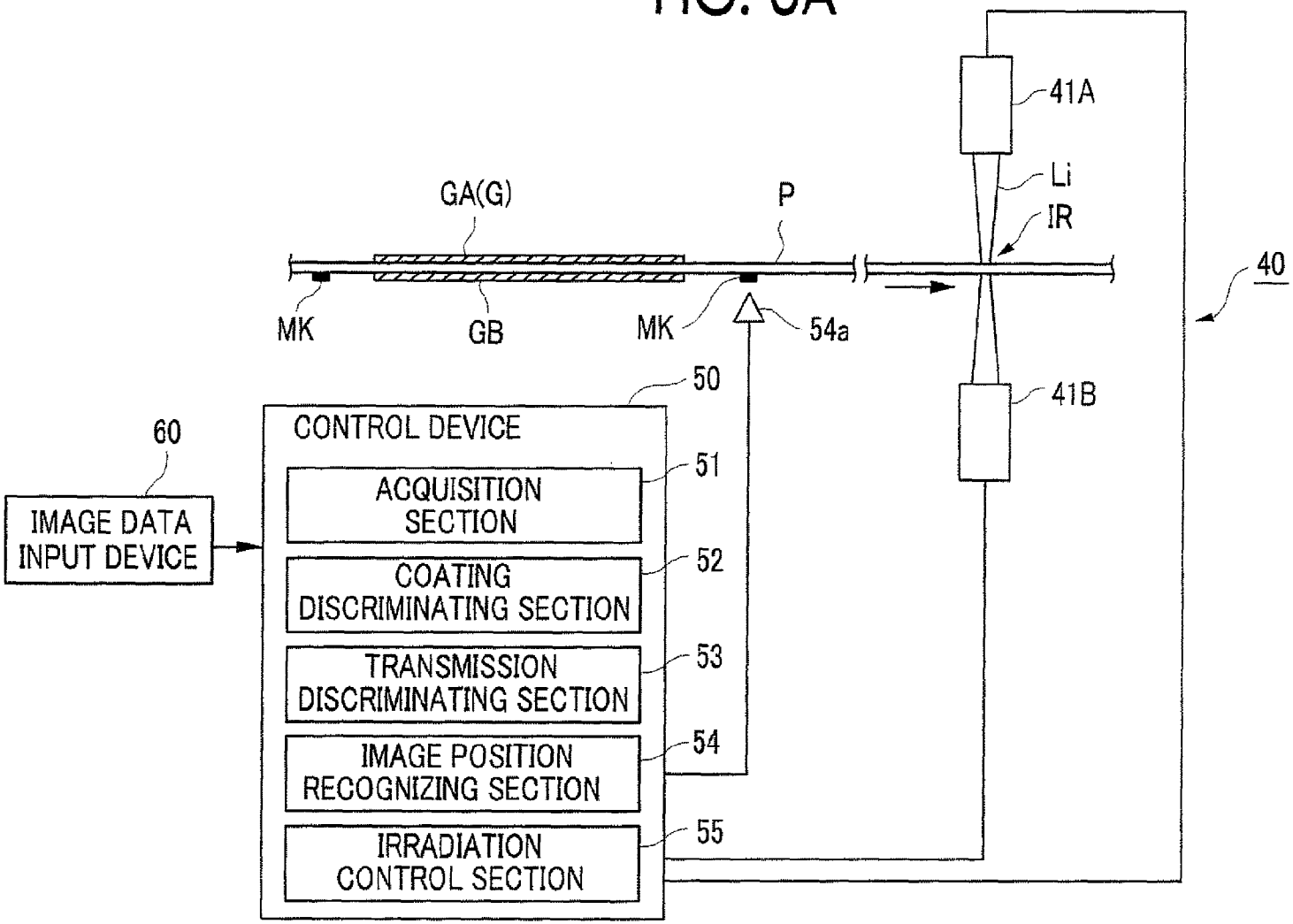
FIG. 6A is a schematic view showing the fixing device of Exemplary Embodiment 1.

FIG. 6A is a schematic view showing the outline of the fixing device 40. Toner images GA and GB are formed on both sides of a recording material P, and a mark MK for identifying an image region for every sheet is formed on the toner image GB side of the recording material P. The array lasers 41A and 41B are connected to the control device 50 and are subjected to irradiation control for setting irradiation energy on each side. Moreover, an image data input device 60 is connected to the control device 50 so as to transmit image data serving as image information to the control device 50. In addition, in the drawing, reference numeral 54*a* designates a sensor for detecting the mark MK, and constitutes a part of an image position recognizing section 54 as will be described below.

Figure 6B:
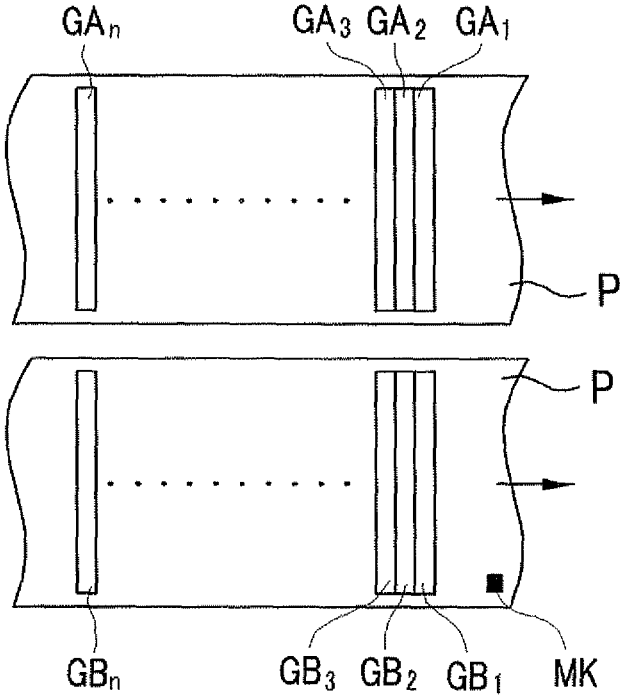
FIG. 6B is an explanatory view showing the relationship between toner images on both sides of a recording material, and divided regions.

Additionally, FIG. 6B shows the relationship between divided regions $GA_1$, to $GA_n$ and $GB_1$ to $GB_n$ that are obtained by dividing the toner images GA and GB when both sides of the recording material P are seen with a size corresponding to the irradiation region IR, respectively. For example, a pair of divided regions $GA_1$ and $GB_1$ of both sides of the recording material P is provided at mutually facing positions.

Although the control device 50 of the present exemplary embodiment also performs a control related to image formation, the irradiation control of the array lasers 41 will be described here.

The control device 50 is composed of an acquisition section 51 that acquires the image data of the toner images G (GA, GB) formed on both sides of the recording material P from the image data input device 60, a coating discriminating section 52 that makes a size corresponding to the first irradiation region IRA and the second irradiation region IRB into a pair of divided regions $GA_n$ and $GB_n$, and acquires a coating level as coating information on the coating level of a toner in the divided region (a size equivalent to the first and second irradiation regions IRA and IRB in this example) on the basis of the image data acquired in the acquisition section 51, a transmission discriminating section 53 that acquires transmission information that relates to the transmission degree of the laser beam Li through the recording material P on the basis of the coating level information acquired by the coating discriminating section 52, an image position recognizing section 54 that recognizes the image position of the toner images G formed on both sides of the recording material P in relation to the irradiation regions IR on the basis of the information from a sensor 54*a*, the irradiation control section 55 that sets the irradiation energy of the array lasers 41A or 41B corresponding to at least one side to a predetermined irradiation energy level, in setting the irradiation energy of the first and second array lasers 41 (41A, 41B) for the divided regions in a case where the toner images G recognized by the image position recognizing section 54 reach the irradiation regions IR and that sets the irradiation energy of the other array lasers 41B or 41A to a value obtained by subtracting the irradiation energy based on the transmission degree acquired by the transmission discriminating section 53.

In the present exemplary embodiment, the image position recognizing section 54 is adapted to detect the mark MK of the recording material P by the sensor 54*a*, and to recognize the timing when a desired divided region of the toner image G reaches the irradiation region IR formed by the array lasers 41 from the transport velocity of the recording material P.

Figure 7:
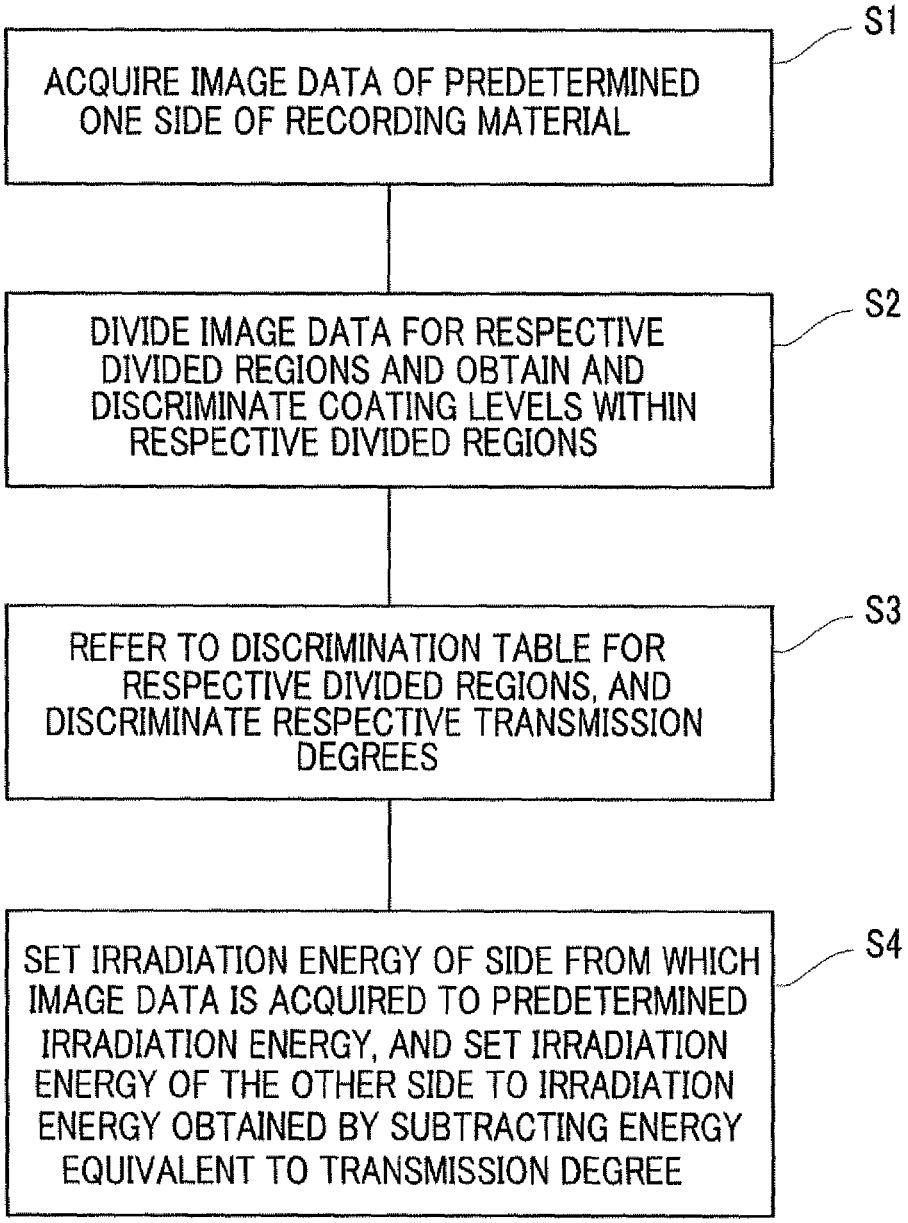
FIG. 7 is a flowchart showing a control flow in a control device of Exemplary Embodiment 1.

Next, the control flow in the control device 50 in the present exemplary embodiment will be described referring to FIGS. 6A and 6B on the basis of the flowchart of FIG. 7.

First, in the acquisition section 51, image data of predetermined one side (for example, the toner image GA side) among the image data of the recording material P is acquired (S1). Next, in the coating discriminating section 52, the image data is divided for the divided regions $GA_1$ to $GA_n$, and the coating levels of the toner in the respective divided regions are obtained and acquired (S2). Then, in the transmission discriminating section 53, respective transmission degrees are acquired, referring to a distinction table on which the coating levels and the transmission degree are correlated for the respective divided regions (S3). At this time, as the discrimination table, the correlation between the coating level and transmission degree of a toner may obtained in advance by an experiment or the like, and may be stored as a table in the transmission discriminating section 53. Subsequently, in the irradiation control section 55, in conformity with a divided region to be recognized to reach the irradiation region IR by the image position recognizing section 54, the irradiation energy of the array laser 41A of a side (a side on which the toner image GA is formed in the present example) from which image data is acquired is set to a predetermined irradiation energy level, and the irradiation energy of the other array laser 41B is set to the irradiation energy obtained by subtracting the energy equivalent to the transmission degree acquired by the transmission discriminating section 53 from the predetermined irradiation energy level (S4).

Next, the effects in the present exemplary embodiment will be described with reference to FIGS. 8A and 8B.

Figure 8A:
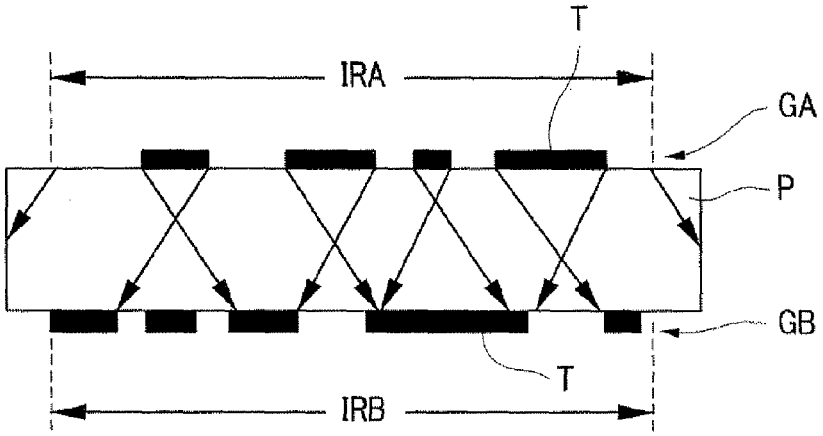
FIG. 8A is an explanatory view showing the action of transmitted light by the laser beam from one side of a recording material.

FIG. 8A is a view as seen in the width direction of the recording material P, and the irradiation regions IRA and IRB of both sides are regions as shown in the drawing. When the toners T of the respective toner images GA and GB are formed as shown in a pair of facing divided regions (the irradiation regions IRA and IRB in this example) of both sides, the laser beam (not shown) from the toner image GA side is transmitted through the recording material P from the portion of the recording material P with no toner T, and spreads toward the toner image GB side, for example as shown by an arrow in the recording material P in the drawing. Therefore, even if laser beam is not irradiated from the toner image GB side by such transmitted light, irradiation energy is also imparted to the toner image GB of the opposite side according to the transmission degree of the transmitted light. Accordingly, the toner T of the toner image GB is fixed with the irradiation energy obtained by subtracting the irradiation energy according to the transmission degree.

Figure 8B:
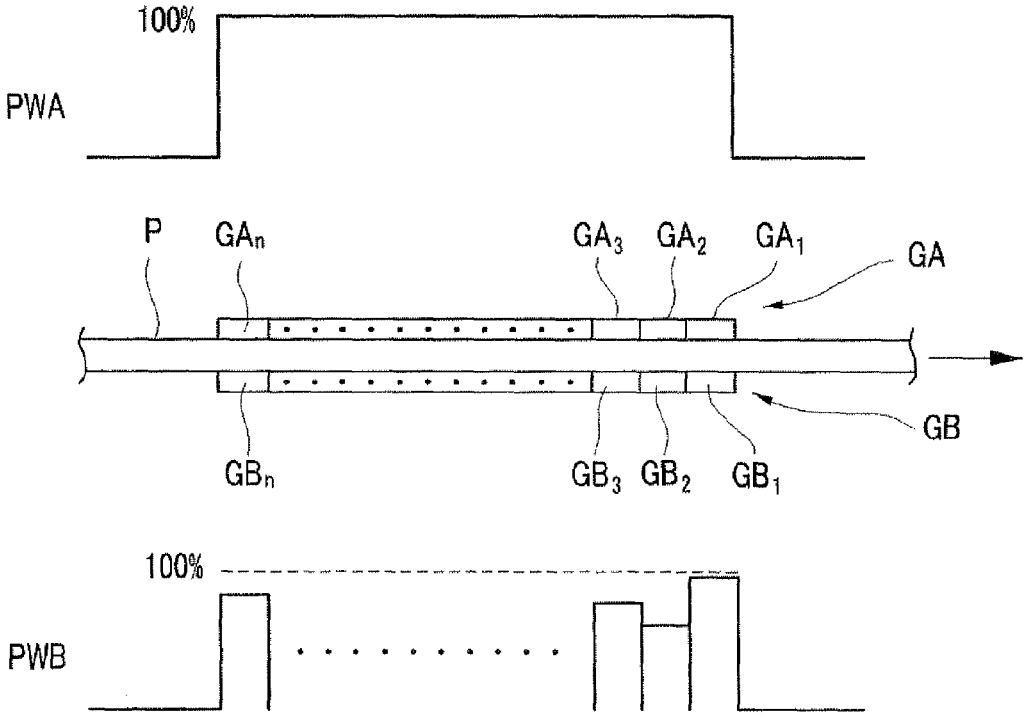
FIG. 8B is an explanatory view showing an example of irradiation energy in Exemplary Embodiment 1.

Additionally, FIG. 8B intelligibly illustrates irradiation energy for both sides when such irradiation control is performed. By performing the irradiation control as in the present exemplary embodiment for the respective divided regions $GA_1$ to $GA_n$ and $GB_1$ to $GB_n$ of both sides of the recording material P, the irradiation energy PWA on the toner image GA side is set to an output of 100% irrespective of the divided regions, but the irradiation energy PWB on the toner image GB side is controlled so as to have a value obtained by subtracting the irradiation energy based on a transmission degree in each divided region (toner image GA side). As a result, compared to the case where the output is 100%, energy is saved and the fixation efficiency is improved.

As described above, according to the control device 50 of the present exemplary embodiment, toner images are formed on both sides of the recording material P by the first image forming section 20A and the second image forming section 20B (refer to FIG. 3), the coating level in the divided region of one predetermined side is obtained before a toner image (for example, GA) formed on the predetermined one side of both the sides reaches the irradiation region IR, a transmission degree is acquired according to the obtained coating level, the irradiation energy of the array laser 41A of the one side is set to a predetermined irradiation energy level, and the irradiation energy of the other array lasers 41B is set to the irradiation energy obtained by subtracting the irradiation energy based on the transmission degree from the predetermined irradiation energy level. Therefore, the fixation efficiency is improved compared to the case where both are set to a predetermined irradiation energy level.

Although the present exemplary embodiment shows the aspect in which the toner image G for which a transmission degree is obtained is predetermined one side of the recording material P, coating levels may be obtained for respective divided regions of both sides from image data of both sides, the irradiation energy for the divided region in the side with a smaller coating level may be set to a predetermined irradiation energy level, and the irradiation energy for the divided region of the other side may be reduced according to a transmission degree. Additionally, either side may be arbitrarily selected.

Additionally, although the present exemplary embodiment shows the aspect in which the array laser 41 is provided at a position farther from the recording material P than the reflective member 42, for example, the array laser 41 may be brought close to the recording material P side, and the laser beam Li may be irradiated from the same position as a reflecting surface 42*b* of the reflective member 42, or the array laser may be arranged inside the reflective member 42 (nearer to the recording material P side than the reflecting surface).

Although the present exemplary embodiment shows the configuration in which an aspect of continuous paper is used as the recording material P, a paper sheet may be used. In this case, for example, a guide mechanism that guides the recording material P toward the fixing device 40, and a transport mechanism for transporting the recording material P may be separately provided.

Additionally, although the present exemplary embodiment shows the aspect including a pair of reflective members 42, the reflective members 42 may not be included. In this case, the irradiation energy of the array lasers 41 may be made a little larger than the case where the reflective members 42 are provided such that the effective use of the reflected light Lr by the reflective members 42 is not achieved.

In the present exemplary embodiment, the aspect in which both the first image forming section 20A and the second image forming section 20B forms a monochrome image is adapted as the image forming apparatus. However, it is also possible to adopt a system that multiplexes multicolor toner images on an intermediate transfer belt, for example, using plural photoreceptors 21, or to adopt a system that forms toner images of plural colors sequentially on one photoreceptor 21, and multiplexes the toner images on the intermediate transfer belt, thereby forming color images on both sides of the recording material P. In such a case, it is also possible to simultaneously perform transfer of the multiplexed toner images on the recording material P.

Moreover, if the polarity of a toner to be used is changed, for example, in the first image forming section 20A and the second image forming section 20B, it is also possible to form toner images on both sides of the recording material P, without using the polarity reversing device 32 (refer to FIG. 3). Additionally, instead of the polarity reversing device 32, for example, a polarity reversing section that reverses the polarity of a toner image (equivalent to an image) on the photoreceptor 21 may be provided between the developing device 24 and the transfer device 25 in the first image forming section 20A, or a well-known system may be adopted as a polarity reversing system.

Exemplary Embodiment 2

Figure 9:
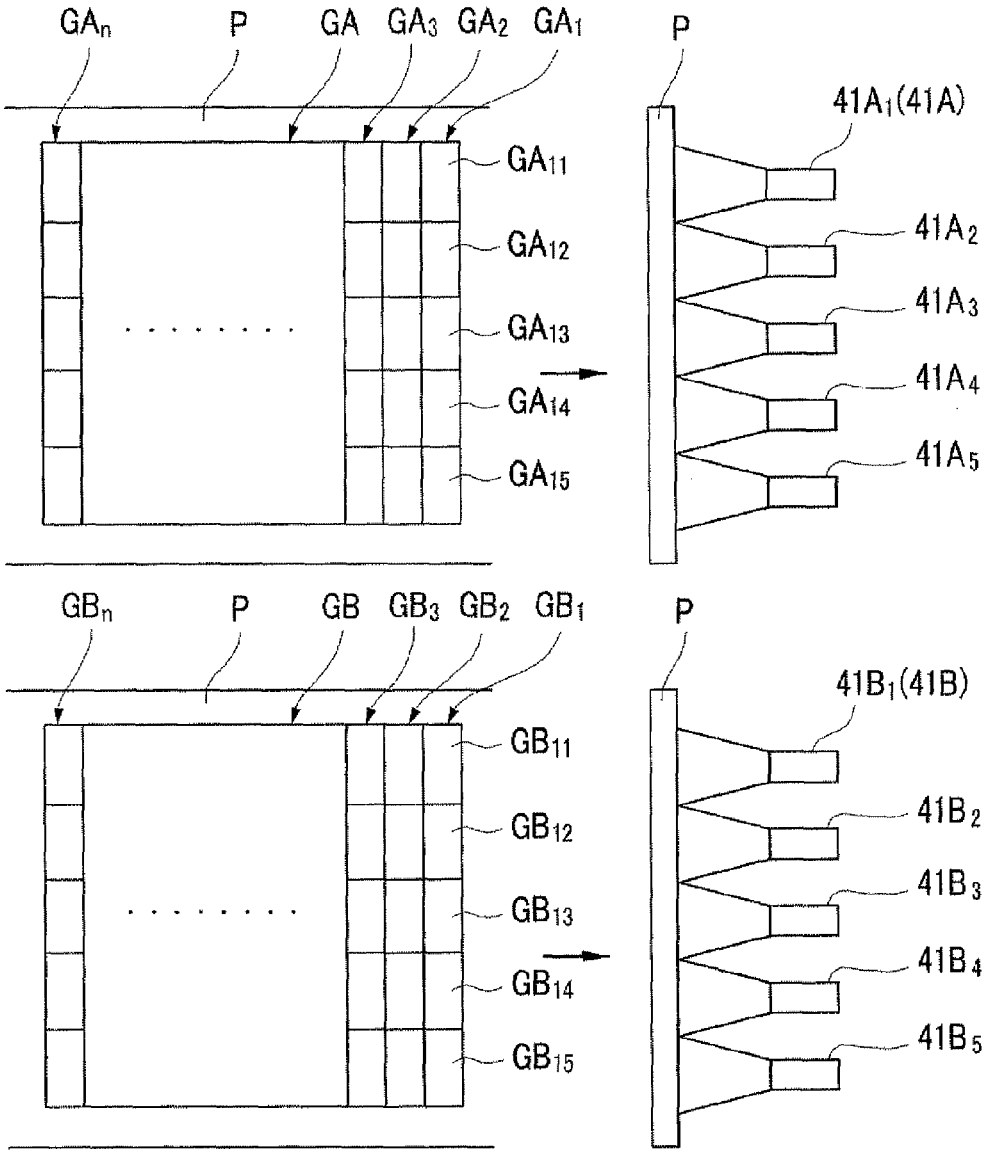
FIG. 9 is a schematic view showing the relationship between divided regions and array lasers in a fixing device of Exemplary Embodiment 2.

FIG. 9 is a schematic view showing the relationship between the divided regions in the toner images GA and GB of both sides of the recording material P by the fixing device of Exemplary Embodiment 2, and the array lasers 41A and 41B of both sides. In the fixing device of Exemplary Embodiment 1, the divided regions are adjusted to the size of the irradiation regions IR. However, in the fixing device of the present exemplary embodiment, the size of the divided regions differs from that of Exemplary Embodiment 1.

In this drawing, the divided regions of the present exemplary embodiment become divided regions (for example, $GA_{11}$ to $GA_{15}$ and $GB_{11}$ to $GB_{15}$) obtained by dividing the regions $GA_1$ to $GA_n$ and $GB_1$ to $GB_n$ of the same size as the irradiation regions into a size corresponding to the respective irradiation ranges of the high-output semiconductor lasers 41$A_1$ to 41$A_5$ and 41$B_1$ to 41$B_5$ of the array lasers 41.

By performing setting in this way, fine control for the array lasers 41 is made, and the fixation efficiency of the respective high-output semiconductor lasers 41$A_1$ to 41$A_5$ and 41$B_1$ to 41$B_5$ is improved.

Here, although the number of the high-output semiconductor lasers 41$A_1$ to 41$A_5$ and 41$B_1$ to 41$B_5$ is shown as five, the number is not particularly limited, and may be a number such that a region capable of fixing the toner image G is covered. Additionally, although the regions corresponding to the respective high-output semiconductor lasers 41$A_1$ to 41$A_5$ and 41$B_1$ to 41$B_5$ are the divided regions, for example, a region that covers plural adjacent high-output semiconductors may be one divided region.

Exemplary Embodiment 3

Figure 10:
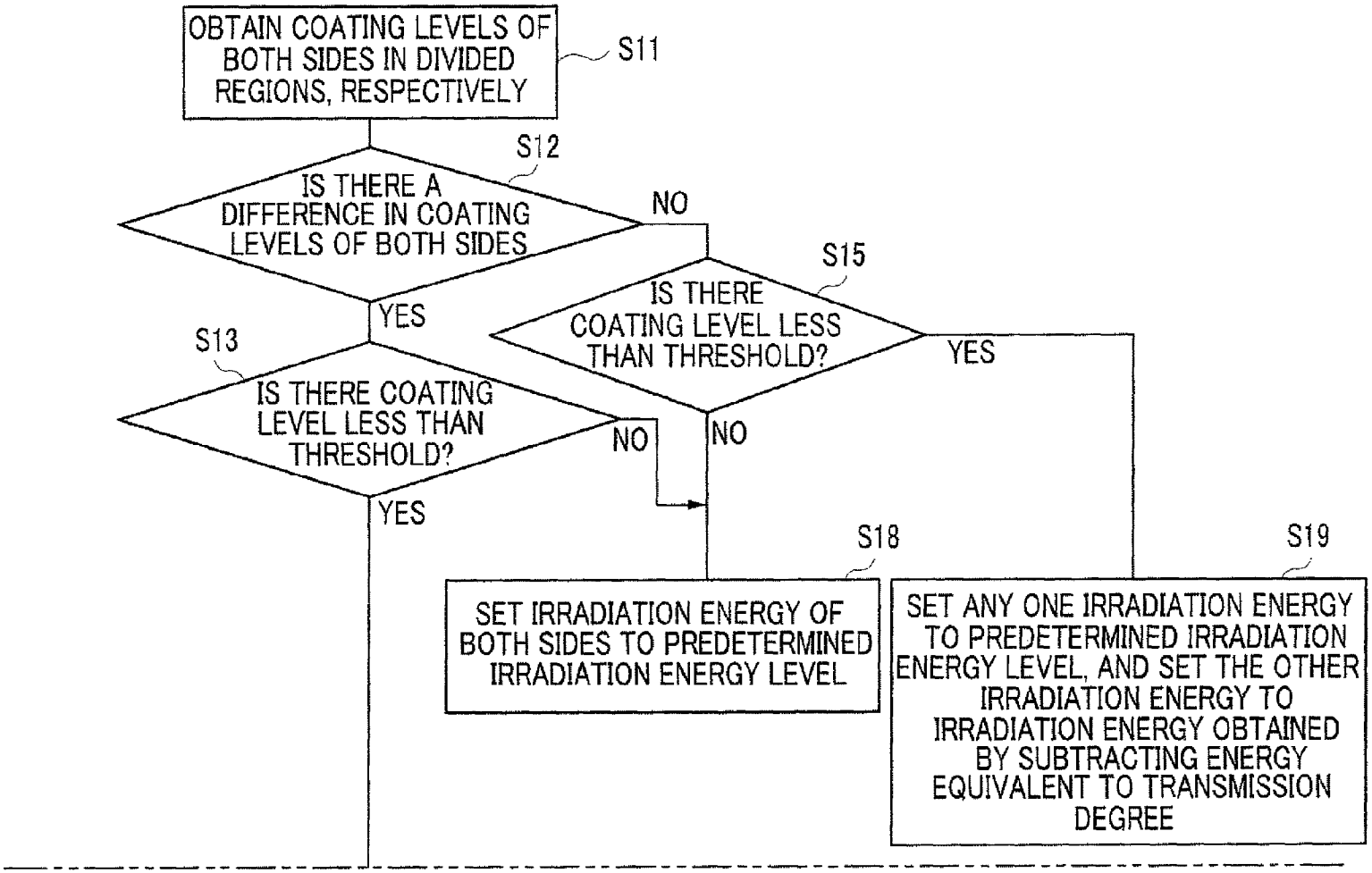
FIG. 10 is a flowchart showing a control flow in a control device of Exemplary Embodiment 3.

FIG. 10 is a flowchart showing a control flow in a control device in a fixing device of Exemplary Embodiment 3. In addition, since the fixing device of the present exemplary embodiment is almost the same as that of FIG. 6A that is the fixing device of Exemplary Embodiment 1, the detailed description thereof is omitted here.

The outline of the fixing device 40 in the present exemplary embodiment will be described referring to FIG. 6A.

In the Exemplary Embodiments 1 and 2, the aspect in which coating levels are used as they are is shown. The coating discriminating section 52 in the fixing device 40 of the present exemplary embodiment is adapted to acquire the size relation of coating levels on both sides of the recording material P from the coating levels of a toner within the irradiation regions IR of the laser beam Li of the array lasers 41A and 41B, on the basis of the image data of toner images formed on both sides of the recording material P acquired by the acquisition section 51. Additionally, the transmission discriminating section 53 is adapted to set a predetermined threshold at which the transmission degree becomes zero for a coating level obtained in the coating discriminating section 52, sets the transmission degree to zero when the coating level is equal to or more than this threshold, and acquires transmission information on the transmission degree for the first time when the coating level is less than this threshold.

Moreover, the irradiation control unit 55 is adapted to set the irradiation energy of the array laser 41A or 41B corresponding to a side with a smaller coating level to a predetermined irradiation energy level when it is acquired by the coating discriminating section 52 that the coating level of either side is smaller than that of the other side, and it is acquired by the transmission discriminating section 53 that the coating level of at least any one is equal to or less than a threshold, in setting the irradiation energy of the array lasers 41A and 41B in a case where the toner image recognized by the image position recognizing unit 54 reaches the irradiation region IR, and sets the irradiation energy of the other array laser 41B or 41A to a value obtained by subtracting the irradiation energy based on the transmission information acquired by the transmission information acquiring unit 53 from the predetermined irradiation energy level.

That is, in the fixing device 40 of the present exemplary embodiment, with respect to a coating level acquired in the coating discriminating section 52, the transmission discriminating section 53 is adapted to acquire a transmission degree if the coating level is less than a threshold, without discriminating the transmission degree if there is no irradiation region IR (equivalent to a divided region) with a coating level less than the threshold. Moreover, when both the coating levels of both sides of the recording material P are less than a threshold, the coating discriminating section 52 and the transmission discriminating section 53 determine the array laser 41A or 41B to be set to a value obtained by subtracting the irradiation energy caused by a transmission degree according to the size relation of the coating levels. Therefore, in the present exemplary embodiment, various kinds of case sorting are performed when irradiation energy is set.

A control flow in such a control device 50 will be described on the basis of a flowchart of FIG. 10. In addition, in order to simplify description, description will be made with a divided region as a size equivalent to the irradiation region IR.

First, the coating discriminating section 52 obtains the coating levels in the divided regions on both sides of the recording material P from the acquired image data, respectively (S11). Next, whether or not there is a difference in the coating levels of both sides obtained is determined (S12). When there is a difference in the coating levels of both sides, in the transmission discriminating section 53, whether or not there is a coating level that is less than a predetermined threshold in the coating levels of both sides, and if there is any coating level that is less than the threshold, whether or not the coating levels of both sides are less than the threshold is determined (S13, S14). When both the coating levels of both sides are less than the threshold, the irradiation energy of the array laser 41 corresponding to a side with a smaller coating level is set to a predetermined irradiation energy level, and the irradiation energy of the other array laser 41 is set to the irradiation energy obtained by subtracting the irradiation energy according to a transmission degree (S16).

When one coating level of one of both sides is not less than the threshold in Step S14, that is, one coating level is less than the threshold, and the other coating level is equal to or more than the threshold, the irradiation energy whose coating level is less than the threshold is set to a predetermined irradiation energy level, and the other irradiation energy is set to the irradiation energy obtained by subtracting the irradiation energy according to a transmission degree (S17).

Additionally, when it is determined in Step S12 that there is no difference in the coating levels of both sides, whether or not both the coating levels are less than the threshold is determined in the transmission discriminating section 53 (S15). Then, when it is determined in Step S15 that both the coating levels of both sides are not less than the threshold, that is, is equal to or more than the threshold, and when it is determined in Step S13 that both the coating levels of both sides are not less than the threshold, that is, are equal to or more than the threshold, all the irradiation energy of both sides is set to a predetermined irradiation energy level (S18).

Moreover, when both the coating levels of both sides are the same value that is less than the threshold in Step S15, the irradiation energy of any one is set to a predetermined irradiation energy level, and the other irradiation energy is set to the irradiation energy obtained by subtracting the irradiation energy according to a transmission degree (S19).

As described above, according to the control device 50 of the present exemplary embodiment, the coating levels in the divided regions of both sides are obtained, respectively, before the toner images G formed on both sides on the recording material P reach the irradiation regions IR, and the irradiation energy of the first array laser 41A and the second array laser 41B is controlled according to the obtained coating levels, that is, according to when both the coating levels of both sides are equal to or more than a threshold, when only the coating level of one side is less than the threshold, and when both the coating levels of both sides are less than the threshold. Therefore, if the coating level of the divided region of at least one side of the recording material P is less than the threshold, the irradiation energy of one array laser 41 is set to the irradiation energy obtained by taking into consideration a transmission degree, and subtracting the irradiation energy based on this transmission degree. Therefore, the use efficiency of laser beam is enhanced compared to the case where the irradiation energy on both sides is set to a predetermined irradiation energy level.

Although the aspect in which a certain threshold is provided as a coating level and whether or not irradiation energy is reduced depending to a threshold is determined is shown in the present exemplary embodiment, as such a threshold, for example, a value such as 60% may be confirmed and determined in advance by an experiment or the like.

Although coating levels are obtained, or the size relation of the coating levels or the relationship with the threshold are performed in the coating discriminating section 52 and the transmission discriminating section 53, these may be performed in one discriminating section, or the procedure of determination may be changed.

Although the irradiation region IR is one divided region in the present exemplary embodiment, it goes without saying that the divided region may be subdivided. Additionally, the divided region may not be fixed, but may be a divided region that differs, for example, according to the kinds (for example, a character image, a photographic image, and the like) of images. In this case, for example, in a character image, a solid image is small, and a divided region may be enlarged on that point. On the other hand, since the number of solid images increases in a photographic image, the divided region may be set to be small. Otherwise, the control of setting the irradiation energy of both sides to a predetermined irradiation energy level, for example, in the case of the photographic image, and performing the adjustment of irradiation energy only in the case of the character image, may be adopted. In this case, fixation according to images is further improved.

Although the present exemplary embodiment shows the aspect in which, when the irradiation energy of the array laser 41 is controlled on the basis of the coating levels obtained from the image data of both sides of the recording material P, irradiation energy is reduced depending on whether or not there is a coating level that is less than a predetermined threshold in the coating levels of both sides, attention may be paid only to the coating level of one side of the recording material 2, and if there is a divided region that is less than a threshold in this coating level, the irradiation energy of the array laser 41 of the opposite side may be reduced. Additionally, if there is simply a difference in the coating levels of both sides, without considering a threshold, the irradiation energy of the array laser 41 corresponding to a side with a smaller coating level may be set to a predetermined irradiation energy level, and the irradiation energy of the other array laser 41 may be set to the irradiation energy obtained by subtracting the irradiation energy based on a transmission degree.

Modification

In Exemplary Embodiment 3, the aspect in which one value is determined in advance as a threshold is shown. However, irradiation energy divided into several ranges may be provided, for example, by dividing a coating level into several coating levels and setting transmission degrees according to respective divided ranges in advance. That is, as the coating level becomes smaller, the rate at which the laser beam Li is transmitted through the recording material. P increases, and the irradiation energy from the transmitted light to a toner image on the opposite side tends to increase. In this case, since the reduction rate of irradiation energy is also divided into several rates by dividing a coating level, the control of irradiation energy tends to become easy.

Figure 11A:
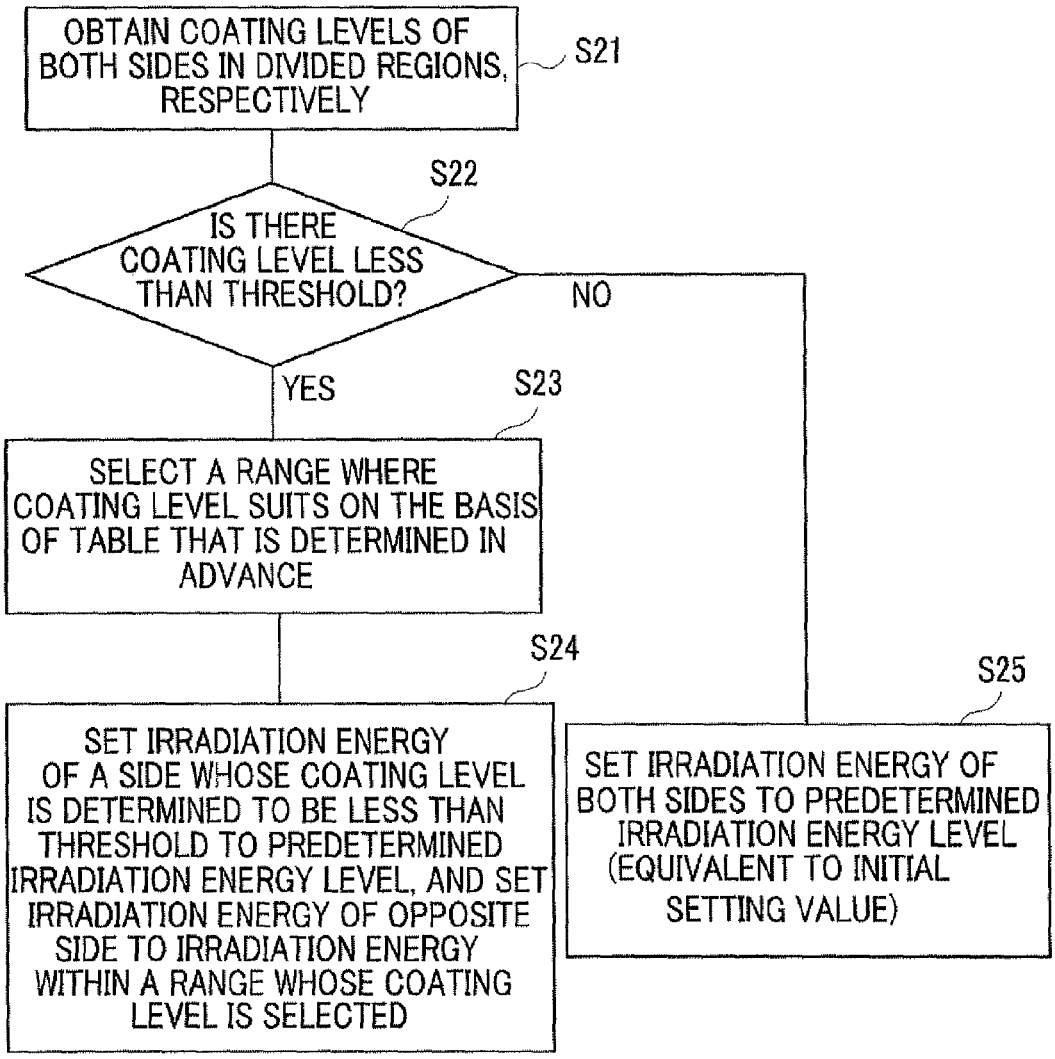
FIG. 11A is a flowchart showing a control flow as a modification.

FIG. 11A shows a control flow in such a modification, and the coating levels of both sides within divided regions are first obtained, respectively (S21). Next, it is determined whether or not there is a coating level that is less than a predetermined threshold in the obtained coating levels (S22). Then, when it is determined that there is a divided region whose coating level is less than the threshold, a range which is appropriate for the obtained coating level is selected on the basis of a table that is determined in advance, the irradiation energy of the array laser 41 of a side whose coating level is determined to be less than the threshold is set to a predetermined irradiation energy level (equivalent to an initial setting value), and the irradiation energy of the opposite side is set to irradiation energy within a range whose coating level is selected (S23, S24). On the other hand, when there is no toner image whose coating level is less than the threshold in Step S22, all irradiation energy of both sides is set to a predetermined irradiation energy level (equivalent to an initial setting value) (S25).

An example of such a table is shown in FIG. 11B. Here, the divided ranges of a threshold are divided into a, b, and c (a>b>c), and there are a, b, and c as ranges where irradiation energy levels, i.e., coating levels corresponding to the respective ranges are divided. According to these divisions, the irradiation energy of the opposite side is set to A, B, and C (initial setting value>A>B>C) according to the divided ranges of the respective thresholds. Therefore, on the basis of such a table, corresponding irradiation energy is selected depending on the value of a coating level.

By doing so in such a way, compared to a system in which irradiation energy is adjusted depending on whether or not a coating level is less than one threshold, a coating level is divided into plural ranges, and the irradiation energy selected according to the divided ranges is determined. Therefore, irradiation energy may be made into discrete quantities, and it becomes easy to control the array laser 41.

Exemplary Embodiment 4

Figure 12:
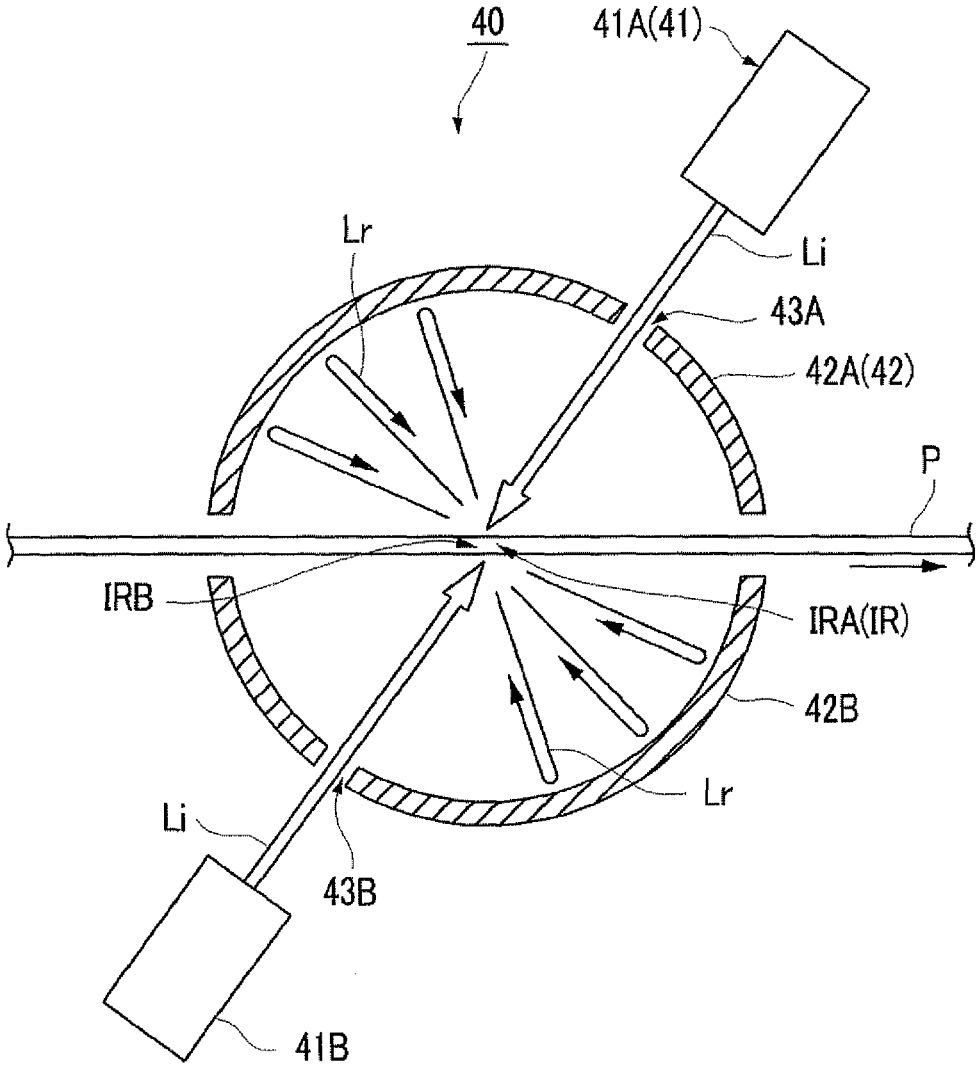
FIG. 12 is an explanatory view showing the outline of a fixing device of Exemplary Embodiment 4.

FIG. 12 shows the outline of a fixing device 40 of an Exemplary Embodiment 4 that is different from the fixing device 40 (refer to FIG. 5) of Exemplary Embodiment 1. In addition, the same constituent elements as those of Exemplary Embodiment 1 will be designated by the same reference numerals, and the detailed description thereof will be omitted herein.

In the fixing device 40 of the present exemplary embodiment, openings 43A and 43B of a pair of reflective members 42 (42A, 42B) are not provided substantially at central parts of the reflective members 42 in the direction along the transport direction of the recording material P, but are provided in directions biased from the central parts. Therefore, neither of the laser beams Li from the array lasers 41 (41A, 41B) are irradiated from a direction orthogonal to the recording material P, but are irradiated from an angle.

By adopting such an arrangement, a large amount of reflected light Lr from the first irradiation region IRA by the laser beam Li from the first array laser 41A is reflected toward the upstream side in the transport direction of the recording material P from the opening 43A of the reflective member 42A. However, for example, since this part is greatly covered with the reflective member 42A, the reflecting surface of the reflective member 42A is also large, and it becomes easy to apply the reflected light Lr again toward the first irradiation region IRA. Therefore, the fixation efficiency is improved. Additionally, this is also the same on the second array laser 41B side, and the reflected light Lr from the second irradiation region IRB is effective used.

Further in such a configuration, similarly to Exemplary Embodiment 1, the irradiation energy of one array laser 41 may be adjusted on the basis of the coating levels of both sides of the recording material P, or the irradiation energy of the array laser 41 of the opposite side may be reduced on the basis of the coating level of only one side of the recording material P.

Although the arrangement in which the laser beams Li from the first array laser 41A and the second array laser 41B become substantially linear with the recording material P therebetween is shown herein, for example, the second array laser 41B may be arranged on the first array laser 41A side, that is, on the downstream side in the transport direction of the recording material P.

Exemplary Embodiment 5

Figure 13:
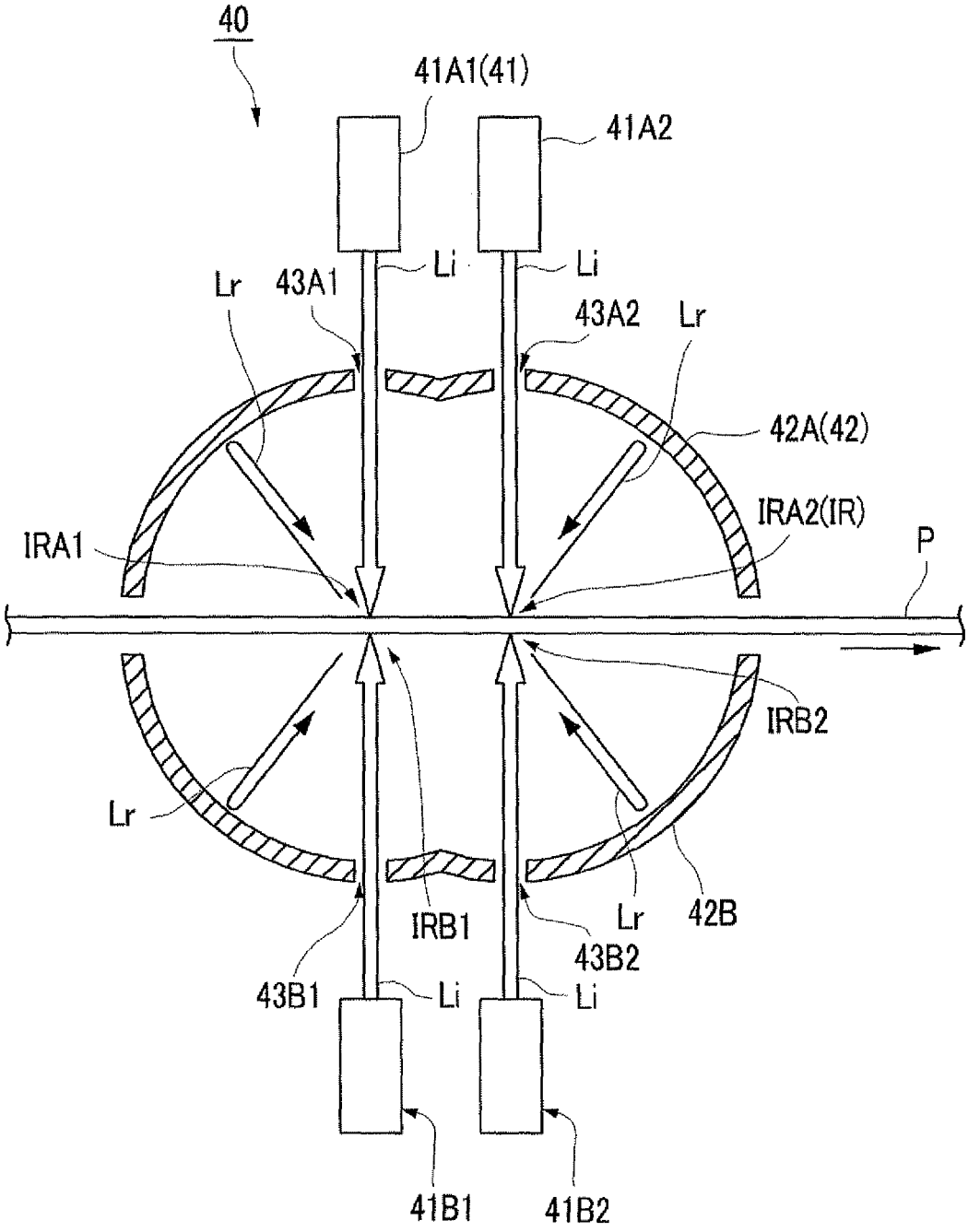
FIG. 13 is an explanatory view showing the outline of a fixing device of Exemplary Embodiment 5.

FIG. 13 shows the outline of a fixing device 40 of an Exemplary Embodiment 5 that is different from the fixing device 40 (refer to FIG. 5) of Exemplary Embodiment 1. In addition, the same constituent elements as those of Exemplary Embodiment 1 will be designated by the same reference numerals, and the detailed description thereof will be omitted herein.

In this drawing, the fixing device 40 of the present exemplary embodiment is adapted to have two irradiation regions IR along the transport direction for one side of the recording material P. The fixing device has two first irradiation regions $IRA_1$ and $IRA_2$ and two second irradiation regions $IRB_1$ and $IRB_2$, and includes respective array lasers 41 (specifically, 41A1, 41A2, 41B1, and 41B2) for respective irradiation regions IR. Additionally, the reflective members 42 (specifically, 42A and 42B) have respectively a configuration in which two substantially semi-cylindrical curved surfaces are arranged, and laser beams Li are irradiated via openings 43A1, 43A2, 43B1, and 4352 of the reflective members 42.

Here, a configuration at one side of the recording material P will be described. In such a configuration, irradiation of a laser beam Li is first made on an unfixed image on the recording material P in the upstream irradiation region $IRA_1$ by the upstream array laser 41A1, and after the elapse of a certain time, irradiation of a laser beam Li is performed on the unfixed image in the irradiation region $IRA_2$ by the downstream array laser 41A2.

If irradiation is performed in this way, in a portion (for example, a part of a solid image) on the recording material P where the coating level of a toner is large, the interface temperature between the toner and the recording material P rises in the upstream irradiation region $IRA_1$. Then, although the interface temperature drops gradually in a portion with no irradiation, as the coating level is larger, the surface area is smaller, the amount of heat dissipation is smaller, and the temperature drop is suppressed to a slight amount. Thereafter, as the unfixed damage is heated once again in the downstream irradiation region IRA2, the interface temperature also rises sufficiently, and sufficient adhesion of a toner to the recording material P is secured.

On the other hand, although the interface temperature once rises sufficiently in a portion (for example, a part of a highlighted image) with a small coating level, this temperature drops rapidly. Then, heating is made once again in the downstream irradiation region IRA2, and the rise of the interface temperature is made once again. That is, the interface temperature is secured by two irradiations in the portion with a large coating level, whereas the interface temperature is secured by one irradiation and this is repeated, in the portion with a small coating level. Therefore, both secure sufficient adhesion irrespective of a coating level on the recording material P.

This is also the same on the second array lasers 41B1, and 41B2 side on the opposite side of the recording material P.

In such a configuration, between the two array lasers $41A_1$ and $41B_1$ that are arranged on the upstream side, similarly to Exemplary Embodiment 1, the irradiation energy of one array laser 41 may be adjusted on the basis of the coating levels of both sides of the recording material P, or the irradiation energy of the array laser 41 of the opposite side may be adjusted on the basis of the coating level of only one side of the recording material P. Additionally, this may be similarly performed even between the two array lasers 41A2 and 41E2 that are arranged on the downstream side.

Exemplary Embodiment 6

Figure 14:
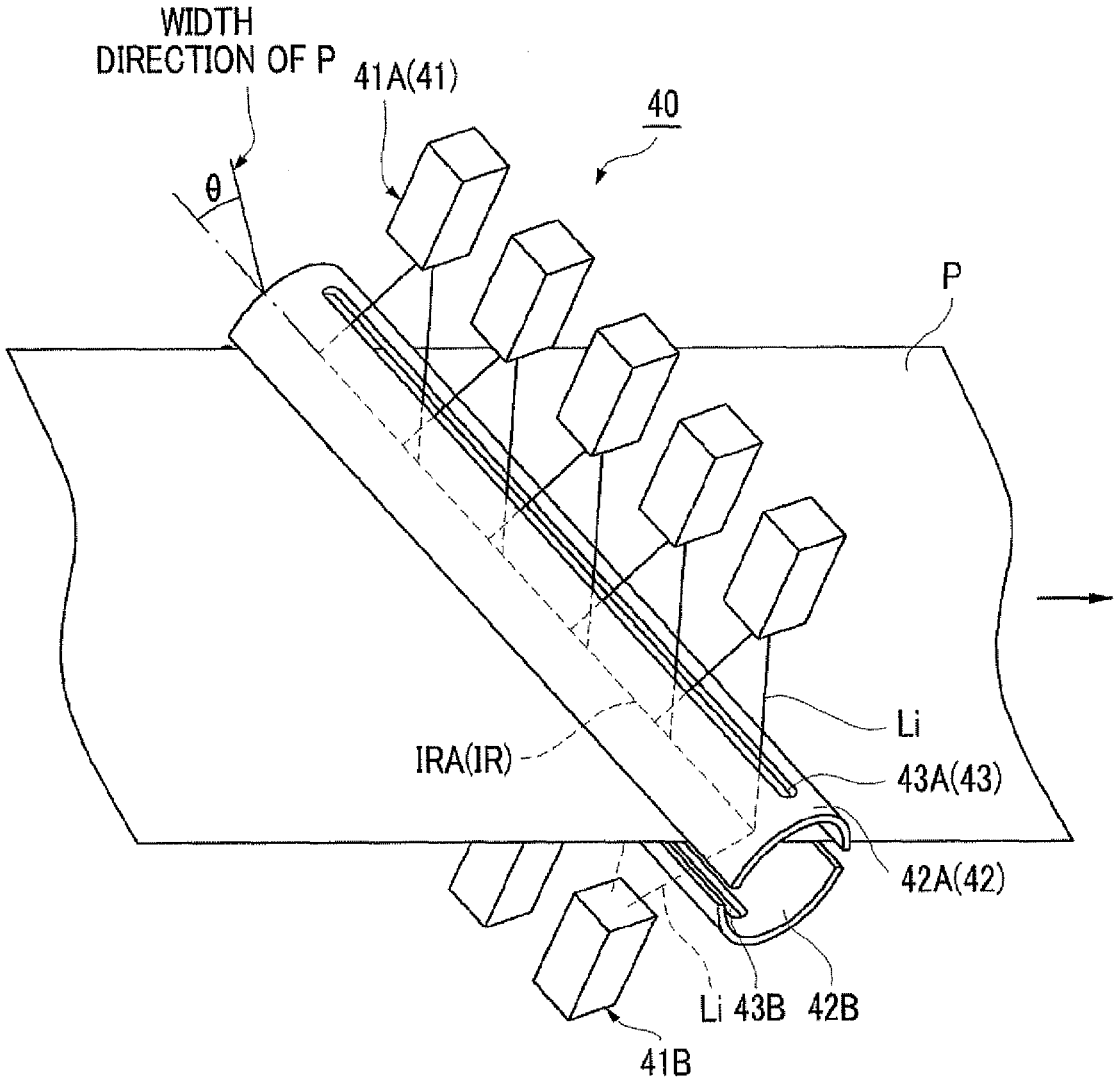
FIG. 14 is a perspective view showing a fixing device of Exemplary Embodiment 6.

FIG. 14 is a perspective view when the fixing device 40 of Exemplary Embodiment 4 is seen from an angle, and the irradiation region IR is set so as to incline from the width direction of the recording material P by an inclination angle θ unlike the fixing device 40 (refer to FIG. 4) of Exemplary Embodiment 1.

Therefore, in the present exemplary embodiment, the first array laser 41A and the first reflective member 42A are also laid out in conformity with the first irradiation region IRA. Additionally, also at the reverse side of the recording material P in the drawing, the second irradiation region IRB (not shown) is arranged to face the first irradiation region IRA. In this regard, the second array laser 41B, and the second reflective members 42B are also laid out in conformity with the second irradiation region IRB.

Figure 15A:
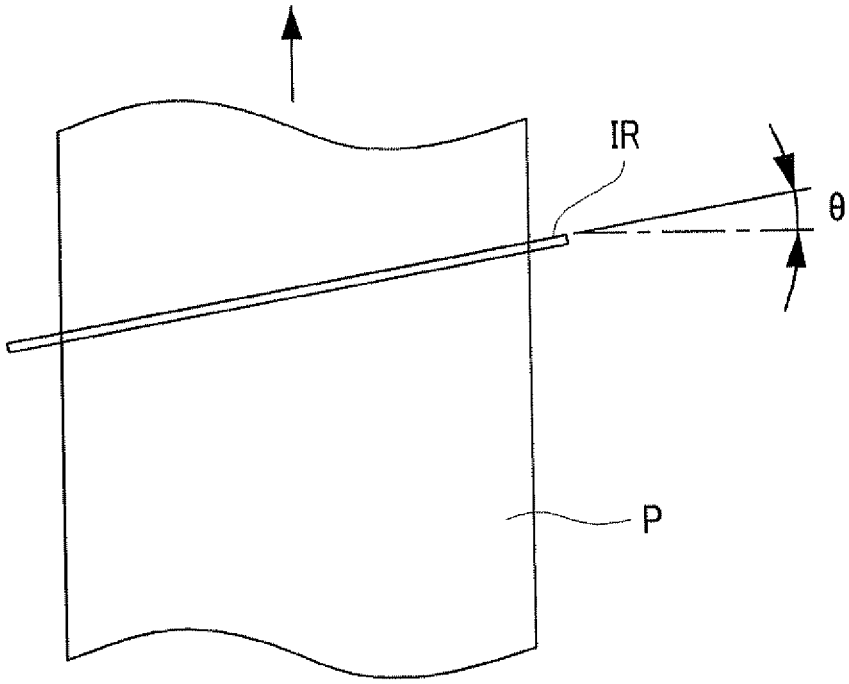
FIG. 15A is an explanatory view showing the relationship between a recording material in the fixing device of Exemplary Embodiment 6, and an irradiation region.
Figure 15B:
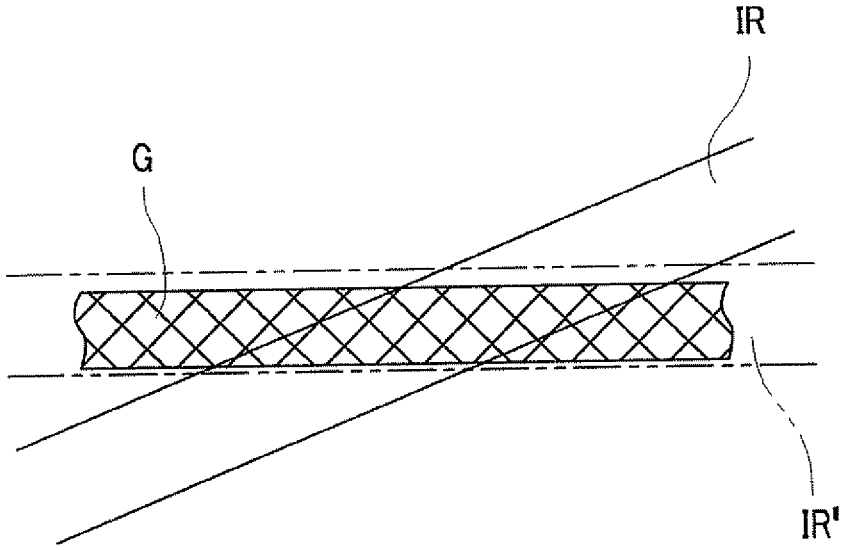
FIG. 15B is an explanatory view showing the relationship between a toner image and an irradiation region.

FIG. 15A shows a state where the irradiation region IR inclines at an inclination angle θ from the width direction of the recording material P, as in the present exemplary embodiment, and FIG. 15B is a schematic view showing the relationship between the irradiation region IR and a toner image G, and also shows an irradiation region IR' when being provided in a direction along the width direction of the recording material P for comparison.

Generally, the direction along the width direction of the recording material P is often used as an arrangement reference direction of an image, and this is also clear from, for example, the format, ruled lines, and the like of a text. The coating level for such an image tends to becomes smaller in a region that is made to incline with respect to the width direction of the recording material P rather than a region that becomes belt-like along the width direction of the recording material P.

As shown FIG. 15B, when a rectangular toner image G as shown in the drawings is made to pass through two irradiation regions IR and IR' the coating level becomes large in the case of the irradiation region IR' provided along the width direction of the recording paper P. However, when the irradiation region IR is made to incline, the coating level shows the tendency to become small. When a laser beam is irradiated to such a toner image G from one side (here, a side that faces the toner image G is assumed) of the recording material 2, in the case of the irradiation region IR', the portion of the irradiated laser beam that is transmitted through the recording material P decreases as a coating level becomes large, and the amount contributed to heating to the toner image G on the opposite side becomes small.

On the other hand, since the coating level becomes small when the inclined irradiation region IR is used, the portion of the laser beam that is transmitted through the recording material P increases. In this regard, the irradiation energy by the transmitted light that contributes to fixation of the toner image G on the opposite side increases. As a result, even if the irradiation energy of a laser beam from the opposite side to the toner image G on the opposite side is reduced, sufficient fixation is made.

If the inclination angle θ of such an irradiation region IR becomes too large, as the radiation region IR becomes long with respect to the width of the recording material P, the irradiation range by the array laser 41 becomes wide. As a result, it is necessary to increase the number of high-output semiconductor lasers, for example. Accordingly, it is not advisable to set the inclination angle θ to a great extent. For example, several degrees are preferable.

Exemplary Embodiment 7

Figure 16A:
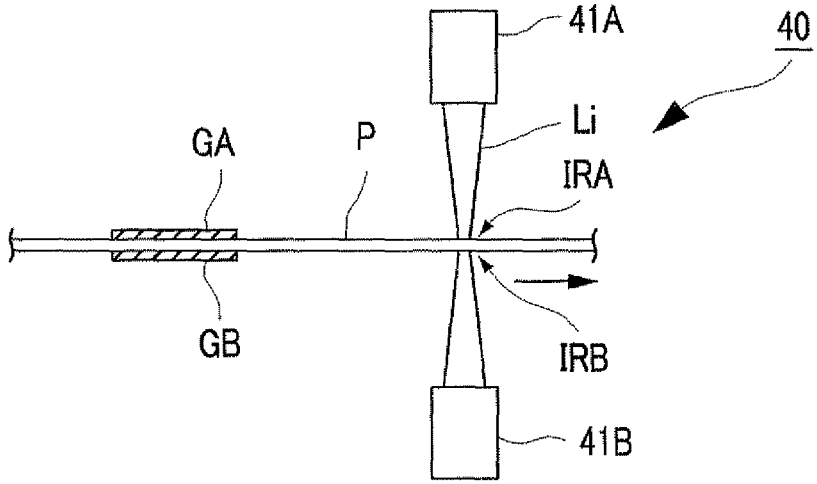
FIG. 16A is a schematic view showing the outline of a fixing device of Exemplary Embodiment 7.

FIG. 16A is a schematic view showing the outline of a fixing device 40 of Exemplary Embodiment 7. Although the fixing device 40 of the present exemplary embodiment is configured so as to be almost the same as the fixing device of Exemplary Embodiment 1, this fixing device differs from Exemplary Embodiment 1 in that attention is paid to the mutual relationship between coating levels in the respective irradiation regions IRA and IRB, with respect to the toner images GA and GB of both sides of the recording material P. In addition, the same constituent elements as those of Exemplary Embodiment 1 will be designated by the same reference numerals, and the detailed description thereof will be omitted herein.

In the present exemplary embodiment, in setting the irradiation energy of each of the array lasers 41A and 41B corresponding to both sides of the recording material P, the irradiation energy is set in consideration of transmission degrees in the toner images GA and GB on both sides of the recording material P. That is, in the array laser 41A of one side, fixation of the toner image GA is made by adding the irradiation energy by the transmitted light from the array laser 41B of the opposite side to the irradiation energy of the laser beam Li from the array laser 41A, and fixation of the toner image GB on the array laser 41B side is similarly made.

Figure 16B:
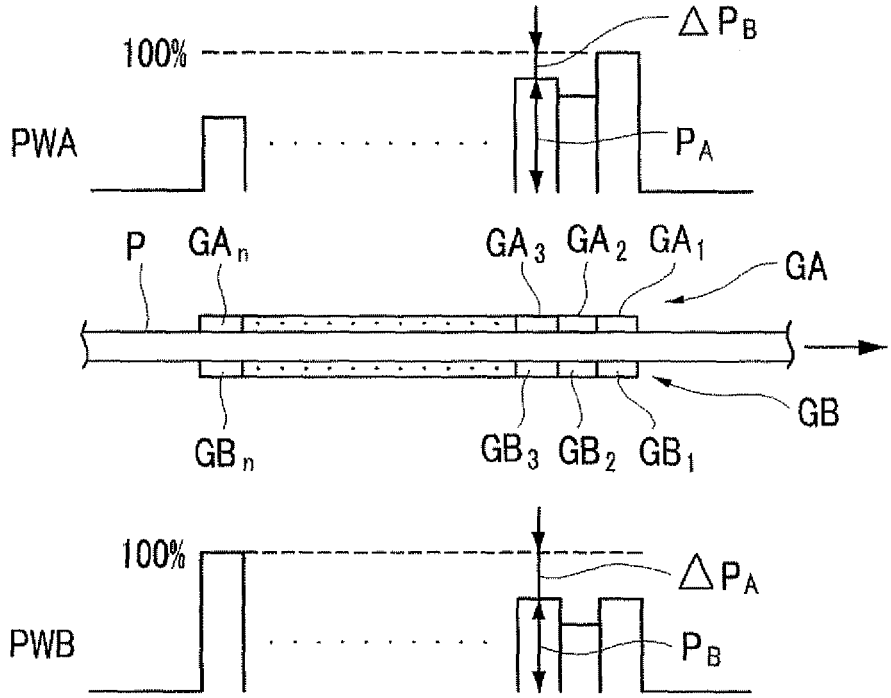
FIG. 16B is an explanatory view showing an example of irradiation energy in Exemplary Embodiment 7.

Additionally, FIG. 16B intelligibly illustrates irradiation energy on both sides when such irradiation control is performed. By performing the irradiation control as in the present exemplary embodiment for the respective divided regions $GA_1$ to $GA_n$ and $GB_1$ to $GB_n$ of both sides of the recording material P, a transmission degree on the toner image GB side is taken into consideration for the irradiation energy PWA on the toner image GA, while a transmission degree on the toner image GA side is taken into consideration for the irradiation energy PWA on the toner image GB. For example, when a region between the divided regions $GA_3$ and $GB_3$ in the drawing is mentioned as an example, the irradiation energy PWA to the toner image GA becomes the sum total of the irradiation energy $P_A$ from the array laser 41A and a transmission degree amount $\Delta P_B$ from the array laser 41B. On the other hand, the irradiation energy PWB to the toner image GB becomes the sum total of irradiation energy $P_8$ from the array laser 41B and a transmission degree amount $\Delta P_A$ from the array laser 41A. Therefore, sufficient fixation of both the toner images GA and GB of both sides is made. By adopting such a system, compared to a case where irradiation energy on one side is set to 100%, the irradiation energy as a whole can be reduced and the use efficiency of irradiation energy is enhanced.

Exemplary Embodiment 8

Figure 17A:
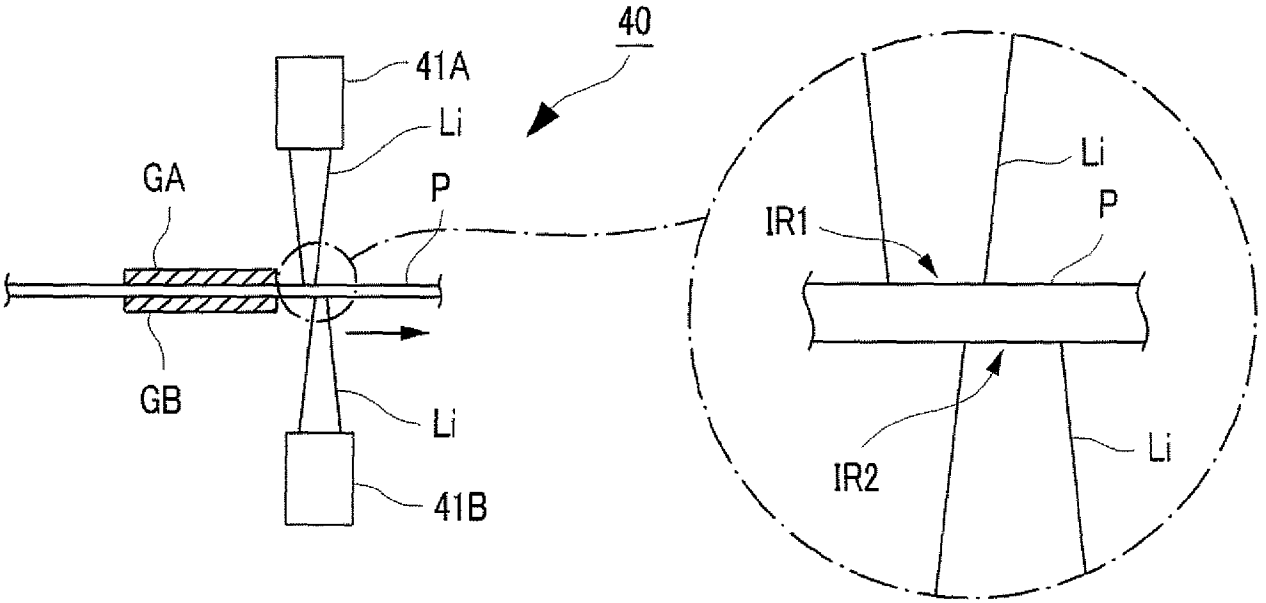
FIG. 17A is a schematic view showing the outline of a fixing device of Exemplary Embodiment 8.

FIG. 17A is a schematic view showing the outline of a fixing device 40 of Exemplary Embodiment 8. Unlike the fixing device of Exemplary Embodiment 1, the fixing device 40 of the present exemplary embodiment is adapted such that the second irradiation region IR2 is biased to the downstream side compared to the first irradiation region IR1 in a partially overlapped state. In addition, since the control device or the like are configured similarly to Exemplary Embodiment 1, the details thereof are omitted herein.

Figure 17B:
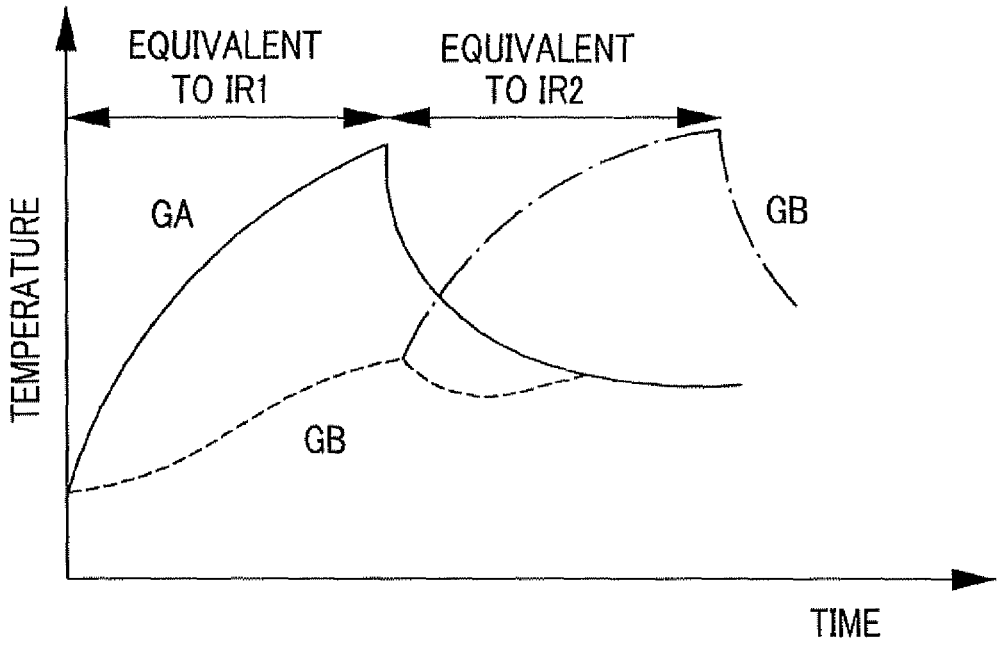
FIG. 17B is an explanatory view showing the situation of a temperature change of toner images on both sides of a recording material.

Additionally, FIG. 17B shows the situation of a temperature change on the surface of a toner in the toner image GA when the laser beam Li from the array laser 41A is irradiated to the toner image GA side on the recording material P, and the toner image GB on the reverse side. The toner image GA shows the tendency that temperature rises rapidly in the irradiation region IR1 and temperature drops rapidly when passing the irradiation region IR1, as indicated by a solid line in the drawing. On the other hand, the toner image GB on the reverse side shows the tendency that, although being heated due to the irradiation energy by the transmitted light, the temperature rises slowly at the beginning, then the temperature rises suddenly, and the temperature drops when passing the irradiation region IR1, as indicated by a dotted line. Thereafter, the toner image shows the tendency that heating caused by the melting of the toner is applied to the recording material P itself, and the temperature drops somewhat slowly.

In the present exemplary embodiment, the temperature of the toner image GB on the reverse side rises (a portion indicated by a dot line in the irradiation region IR1) by irradiating a laser beam Li from one side (for example, surface) to the toner images GA and GB of both sides. While the temperature does not drop, that is in a range in which the remaining heat caused by the irradiation energy by the array laser 41*a* of the irradiation region IR1 is held, the temperature of the toner image GB rises as indicated by a two-dot chain line by irradiating the laser beam Li to the reverse side. Therefore, even when the irradiation energy on the reverse side (the irradiation energy from the array laser 41B side) is made small, melting of the toner is sufficiently performed. In such a case, in order to effectively use the irradiation energy from one side, it is needless to say that a shorter overlapped region is preferable.

Here, although the irradiation regions IR1 and IR2 of both sides are arranged such that inlet portions thereof overlap each other, as shown in FIG. 17B, the toner image GA is melted by irradiation to the irradiation region IR1. In that case, however, the temperature of the recording material P itself also rises gradually by heat conduction. Therefore, it is also possible to delay the region of the irradiation region IR2 in a range in which the remaining heat caused by the temperature rise of the recording material P is held. Therefore, it is possible to set the irradiation regions IR1 and IR2 of both sides at a certain distance in the transport direction of the recording material P. In addition, although such a distance is obtained by an experiment or the like, usually, the distance is set to a distance of 100 ms or less.

EXAMPLES

The present example was given by investigating the irradiation energy (referred to as transmission power) that is transmitted through a recording material and the irradiation energy (laser power) required for the other side (here, referred to as a side B) of a recording material, in the laser beam irradiated from one side (here, referred to as a side A) of the recording material, in relation to the coating level of the side A.

Here, the irradiation energy (laser power) to the side A was set to 100% that is a setting value of a predetermined irradiation energy level, the irradiation energy to the side B was also set to 100%, and the reflectivity (reflectivity in the surface of the recording material) and transmissivity of a laser beam in a non-image part on the side A were calculated as 70% and 30%, respectively.

As a result, as shown in FIG. 18, as the coating level in the side A becomes smaller, the transmission power to the side B increases, and it is possible to reduce the laser power to the side B to that extent.

For example, since the transmission power of about 12% can be expected from the side B when the coating level of the side A is 60%, the laser power required for the side B becomes 88%. Additionally, since the transmission power of about 21% can be expected from the side B when the coating level of the side A is 30%, the laser power required for the side B becomes 79%. Moreover, since the transmission power of about 28.5% can be expected from the side B when the coating level of the side A is 5%, the laser power required for the side B becomes 71.5%.

The threshold of a coating level may be obtained from such investigation results. As the threshold, for example, a numerical value of 60% or less is preferable. Additionally, when it is assumed that a coating level is simply calculated as an average value in a target region to the last, a smaller coating level may use the transmitted light more effectively, for example, 20%, 10%, 5%, and the like may be adopted as the threshold.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a first irradiation unit that irradiates a laser beam in a first irradiation region toward a recording medium in which unfixed image is formed on both sides thereof using an image forming material capable of being heated and fixed;

a second irradiation unit that irradiates a laser beam toward a second irradiation region disposed in rear side of the first irradiation region of the recording medium;

an image information acquiring unit that acquires image information of the first irradiation region;

a coating information acquiring unit that divides the first irradiation region into one or a plurality of divided regions, and that acquires coating information that relates to the coating level by the image forming material within the divided region on the basis of the image information acquired by the image information acquiring unit;

a transmission information acquiring unit that acquires transmission information that relates to the laser beam which is irradiated from the first irradiation unit to the first irradiation region and passes through the recording medium on the basis of the coating information acquired by the coating information acquiring unit;

an irradiation control unit that controls the irradiation energy of the second irradiation unit based on the transmission information acquired by the transmission information acquiring unit.

2. The fixing device according to claim 1, wherein the irradiation control unit that sets the irradiation energy to a value obtained by subtracting the irradiation energy based on the transmission information from a predetermined irradiation energy level.

3. The fixing device according to claim 1, wherein the first and second irradiation units have a plurality of laser beam sources arranged along the respective irradiation regions, and the divided region is a region that is divided so as to correspond to an irradiation range obtained by one or a plurality of laser beam sources among the plurality of laser beam sources.

4. The fixing device according to claim 1, wherein the transmission information acquiring unit regards the transmission information as transmission information of a transmission degree of zero when the coating information is equal to or more than a threshold, and acquires the transmission information when the coating information is less than the threshold.

5. The fixing device according to claim 2, wherein the transmission information acquiring unit regards the transmission information as transmission information of a transmission degree of zero when the coating information is equal to or more than a threshold, and acquires the transmission information when the coating information is less than the threshold.

6. The fixing device according to claim 1, wherein the coating information acquiring unit acquires the coating level of the image forming material as the coating information.

7. The fixing device according to claim 2, wherein the coating information acquiring unit acquires the coating level of the image forming material as the coating information.

8. The fixing device according to claim 3, wherein the coating information acquiring unit acquires the coating level of the image forming material as the coating information.

9. The fixing device according to claim 4, wherein the coating information acquiring unit acquires the coating level of the image forming material as the coating information.

10. The fixing device according to claim 1, further comprising:

a pair of reflective members that are provided so as to surround the first and second irradiation regions, respectively, and are adapted to reflect the reflected light from each of the first and second irradiation regions obtained by the laser beam irradiated from the first and second irradiation units so as to be directed again to the recording medium.

11. The fixing device according to claim 2, further comprising:

a pair of reflective members that are provided so as to surround the first and second irradiation regions, respectively, and are adapted to reflect the reflected light from each of the first and second irradiation regions obtained by the laser beam irradiated from the first and second irradiation units so as to be directed again to the recording medium.

12. The fixing device according to claim 3, further comprising:

a pair of reflective members that are provided so as to surround the first and second irradiation regions, respectively, and are adapted to reflect the reflected light from each of the first and second irradiation regions obtained by the laser beam irradiated from the first and second irradiation units so as to be directed again to the recording medium.

13. The fixing device according to claim 4, further comprising:

a pair of reflective members that are provided so as to surround the first and second irradiation regions, respectively, and are adapted to reflect the reflected light from each of the first and second irradiation regions obtained by the laser beam irradiated from the first and second irradiation units so as to be directed again to the recording medium.

14. The fixing device according to claim 5, further comprising:

a pair of reflective members that are provided so as to surround the first and second irradiation regions, respectively, and are adapted to reflect the reflected light from each of the first and second irradiation regions obtained by the laser beam irradiated from the first and second irradiation units so as to be directed again to the recording medium.

15. The fixing device according to claim 6, further comprising:

a pair of reflective members that are provided so as to surround the first and second irradiation regions, respectively, and are adapted to reflect the reflected light from each of the first and second irradiation regions obtained by the laser beam irradiated from the first and second irradiation units so as to be directed again to the recording medium.

16. The fixing device according to claim 7, further comprising:

a pair of reflective members that are provided so as to surround the first and second irradiation regions, respectively, and are adapted to reflect the reflected light from each of the first and second irradiation regions obtained by the laser beam irradiated from the first and second irradiation units so as to be directed again to the recording medium.

17. The fixing device according to claim 8, further comprising:

a pair of reflective members that are provided so as to surround the first and second irradiation regions, respectively, and are adapted to reflect the reflected light from each of the first and second irradiation regions obtained by the laser beam irradiated from the first and second irradiation units so as to be directed again to the recording medium.

18. The fixing device according to claim 9, further comprising:

a pair of reflective members that are provided so as to surround the first and second irradiation regions, respectively, and are adapted to reflect the reflected light from each of the first and second irradiation regions obtained by the laser beam irradiated from the first and second irradiation units so as to be directed again to the recording medium.

19. An image forming apparatus comprising:

a transporting unit that conveys a recording material;

an image forming section that forms unfixed images with an image forming material capable of being heated and fixed on both sides of the recording material; and the fixing device according to claim 1 that fixes the unfixed images formed on both sides of the recording material by the image forming section.

20. A fixing device comprising:

a first irradiation unit that irradiates a laser beam in a first irradiation region toward a recording medium in which unfixed image is formed on both sides thereof using an image forming material capable of being heated and fixed;

a second irradiation unit that irradiates a laser beam toward a second irradiation region disposed in rear side of the first irradiation region of the recording medium;

an image information acquiring unit that acquires image information of the first irradiation region and image information of the second irradiation region;

a coating information acquiring unit that divides the first irradiation region and the second irradiation region into one or a plurality of divided regions, acquires coating information that relates to the coating level by the image forming material within the divided region on the basis of the image information acquired by the image information acquiring unit, and determines quantity of the coating information in the first irradiation region and the second irradiation region;

a transmission information acquiring unit that acquires transmission information that relates to the laser beam which is irradiated from the first irradiation unit or second irradiation unit to the irradiation region and passes through the recording medium on the basis of the coating information acquired by the coating information acquiring unit regarding the first irradiation region or the second irradiation region whichever is determined to have smaller coating information;

an irradiation control unit that sets the irradiation energy to a value obtained by subtracting the irradiation energy based on the transmission information from a predetermined irradiation energy level regarding the first irradiation region or the second irradiation region whichever is determined to have larger coating information.

* * * * *